US008166937B2

(12) United States Patent
Yamaguchi et al.

(10) Patent No.: US 8,166,937 B2
(45) Date of Patent: May 1, 2012

(54) VALVE TIMING CONTROL APPARATUS

(75) Inventors: Takashi Yamaguchi, Obu (JP); Akihiko Takenaka, Anjo (JP)

(73) Assignee: Denso Corporation, Kariya (JP)

( * ) Notice: Subject to any disclaimer, the term of this patent is extended or adjusted under 35 U.S.C. 154(b) by 185 days.

(21) Appl. No.: 12/796,851

(22) Filed: Jun. 9, 2010

(65) Prior Publication Data

US 2010/0313835 A1 Dec. 16, 2010

(30) Foreign Application Priority Data

Jun. 10, 2009 (JP) ..... 2009-139425

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,055,950 A * 5/2000 Schafer et al. ..... 123/90.17
7,182,052 B2 2/2007 Yaoko et al.
7,444,964 B2 11/2008 Kanada et al.
2002/0139332 A1 10/2002 Takenaka

FOREIGN PATENT DOCUMENTS

| | | |
|---|---|---|
| JP | 2002-295276 | 10/2002 |
| JP | 2002-357105 | 12/2002 |
| JP | 2003-172110 | 6/2003 |
| JP | 2006-037886 | 2/2006 |
| JP | 2006-046315 | 2/2006 |

* cited by examiner

*Primary Examiner* — Zelalem Eshete
(74) *Attorney, Agent, or Firm* — Nixon & Vanderhye PC

(57) ABSTRACT

A vane rotor includes a vane to partition an advance chamber from a retard chamber. A valve element communicates a lock port with an exhaust port to drain a fluid from the lock port when moving in a first region including an end of a movable range in the first direction. The regulating member moves in the vane rotor in a thrust direction into a recess dented from an inner surface of the housing by being biased from a resilient member to lock the rotation phase in a regulation phase in the first region when a fluid is drained from the lock chamber. The valve element is configured to communicate an operation port with a supply port to supply a fluid into the advance chamber when being in a throttle region in the first region such that a flow of a fluid supplied to the advance chamber is throttled to be less than a flow of a fluid when the valve element is in the end of the movable range in the first direction.

12 Claims, 19 Drawing Sheets

VALVE TIMING CONTROL APPARATUS

CROSS REFERENCE TO RELATED APPLICATIONS

This application is based on and incorporates herein by reference Japanese Patent Application No. 2009-139425 filed on Jun. 10, 2009.

FIELD OF THE INVENTION

The present invention relates to a valve timing control apparatus for controlling a valve timing of a valve, which is opened and dosed by a camshaft according to a torque transmitted from a crankshaft in an internal combustion engine, by utilizing a hydraulic fluid supplied from a supply source with a driving operation of the internal combustion engine.

BACKGROUND OF THE INVENTION

Conventionally, a known valve timing control apparatus includes a housing, which is rotatable with rotation of a crankshaft and a vane rotor, which is rotatable with rotation of a camshaft and having a vane to partition an operation chamber in the housing in a rotative direction. Such a valve timing control apparatus is configured to change a rotation phase of the vane rotor relative to the housing by supplying a hydraulic fluid into the operation chamber. According to US Patent 2002/0139332 A1 (JP-A-2002-357105), a valve timing control apparatus includes a control valve for controlling a flow of a hydraulic fluid supplied into an operation chamber. The control valve is further configured to control a flow of a hydraulic fluid for locking or releasing a housing relative to a vane rotor.

The valve timing control apparatus of US PATENT 2002/0139332 A1 includes a lock pin for locking the housing relative to the vane rotor by discharging a hydraulic fluid from an inner chamber (lock chamber) of a recess. In addition, the lock pin is configured to release the lock by supplying a hydraulic fluid into the lock chamber. The valve timing control apparatus of US PATENT 2002/0139332 A1 further includes an electromagnetic control valve for controlling a flow direction of a hydraulic fluid relative to an advance chamber and a retard chamber (operation chambers). The electromagnetic control valve is further configured to control an amount of a hydraulic fluid supplied to one of the advance chamber and the retard chamber and discharged from the other of the advance chamber and the retard chamber. The valve timing control apparatus of US PATENT 2002/0139332 A1 further includes another electromagnetic control valve configured to selectively switch a port, which is communicated with a lock chamber, to an outlet port of a supply source or a port communicated with an oil sump. That is, the valve timing control apparatus of US PATENT 2002/0139332 A1 includes two control valves, one being for a phase control and the other one being for a lock pin control.

In such a valve timing control apparatus, when the control valve for a phase control is in a specific region, a communication port of the operation chamber and a communication port of the lock chamber is communicated respectively with a communication port of the supply source and a discharge port. In such a region, a hydraulic fluid is supplied from the supply source into the operation chamber according to a position of the spool valve controlled by the control valve for a phase control. In addition, a hydraulic fluid is discharged from the lock chamber into a lock passage according to a switching operation of the control valve for a lock pin control.

Thus, the lock pin biased from a spring locks the rotation phase. Alternatively, the control valve for a phase control may be in a region to communicate the communication port of the operation chamber and the communication port of the lock chamber with the communication port of the supply source. In such a region, a hydraulic fluid is supplied from the supply source into both the operation chamber and the lock chamber by controlling the two control valves. Thus, the rotation phase can be changed while the lock is released.

However, the valve timing control apparatus of US PATENT 2002/0139332 A1 includes the two control valves for performing a phase control and a lock pin control separately. Accordingly, a large space is needed for accommodating the two control valves. In addition, a large amount of electricity may be consumed to drive the two control valves. Accordingly, it is preferable to perform a phase control and a lock pin control by using a single element of a control valve. However, when the lock pin is operated to lock the rotation phase in such a valve timing control apparatus, the lock pin needs to be locked in an intermediate phase between a maximum advanced phase and a maximum retard phase, while the phase is changed to an advance side or a retard side. In such a condition, when the rotation speed is changed at a high advance speed or a high retard speed, the lock pin cannot be fitted into a lock hole steadily. In such a case, the lock pin may pass the lock hole. Consequently, the phase lock may not be properly performed.

SUMMARY OF THE INVENTION

In view of the foregoing and other problems, it is an object of the present invention to produce a valve timing control apparatus configured to perform a rotation phase control and a phase lock control by using a single element of a single control valve and capable of enhancing a phase lock performance in a regulation phase. According to one aspect of the present invention, a valve timing control apparatus for controlling a valve timing of a valve configured to be opened and closed by a camshaft in accordance with a torque transmitted from a crankshaft of an internal combustion engine, the valve timing control apparatus configured to control the valve timing by utilizing a hydraulic fluid supplied from a supply source with a driving operation of the internal combustion engine, the valve timing control apparatus comprises a housing rotatable with the crankshaft, the housing having a recess dented from an inner surface of the housing. The valve timing control apparatus further comprises a vane rotor rotatable with the camshaft, the vane rotor having a vane partitioning an interior of the housing into an advance chamber and a retard chamber in a rotative direction, the vane rotor configured to change a rotation phase relative to the housing to an advance side or a retard side correspondingly when a hydraulic fluid is supplied into the advance chamber or the retard chamber. The valve timing control apparatus further comprises a lock unit having a lock chamber, the lock unit configured to lock the vane rotor relative to the housing when a hydraulic fluid is discharged from the lock chamber, the lock unit configured to release the lock when a hydraulic fluid is supplied into the lock chamber. The valve timing control apparatus further comprises a valve body having an operation port, which is communicable with the advance chamber and the retard chamber, a lock port, which is communicable with the lock chamber, a supply port, which is configured to be supplied with a hydraulic fluid from the supply source, and an exhaust port configured to discharge a hydraulic fluid. The valve timing control apparatus further comprises a valve element linearly movable in opposite directions including a first direction and a second direction, the valve element configured to communicate the operation port and the lock port respectively with the supply port and the exhaust port when moving in a first region, which is a stroke range including an end of a movable range of the valve element in the first direction, the valve element configured to communicate both the operation port and the lock port with the supply port when moving in a second region, which is a stroke range shifted from the first region in the second direction. The valve timing control apparatus further comprises a bias unit configured to cause a biasing force to bias the valve element in the first direction when being elastically deformed. The valve timing control apparatus further comprises a driving source configured to cause a driving force to move the valve element in the second direction. The lock unit includes a regulating member accommodated in the vane rotor and movable back and forth, the regulating member configured to lock the rotation phase in a regulation phase between a maximum advanced phase and a maximum retard phase when moving in a thrust direction to thrust into the recess, the regulating member configured to release the lock of the rotation phase when moving in a retract direction to be retracted from the recess. The lock unit further includes a resilient member configured to bias the regulating member in the thrust direction to thrust the regulating member into the recess when being in the regulation phase, the resilient member configured to bias the regulating member to be in contact with an inner surface of the housing when being in a rotation phase other than the regulation phase. The first region is a lock region in which the regulating member locks the rotation phase in the regulation phase. The first region includes a throttle region in which the operation port, which is communicated with the advance chamber, is further communicated with the supply port such that an advance supply flow supplied to the advance chamber is throttled to be less than an advance supply flow when the valve element is in the end of the movable range in the first direction.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiments

Figure 1:
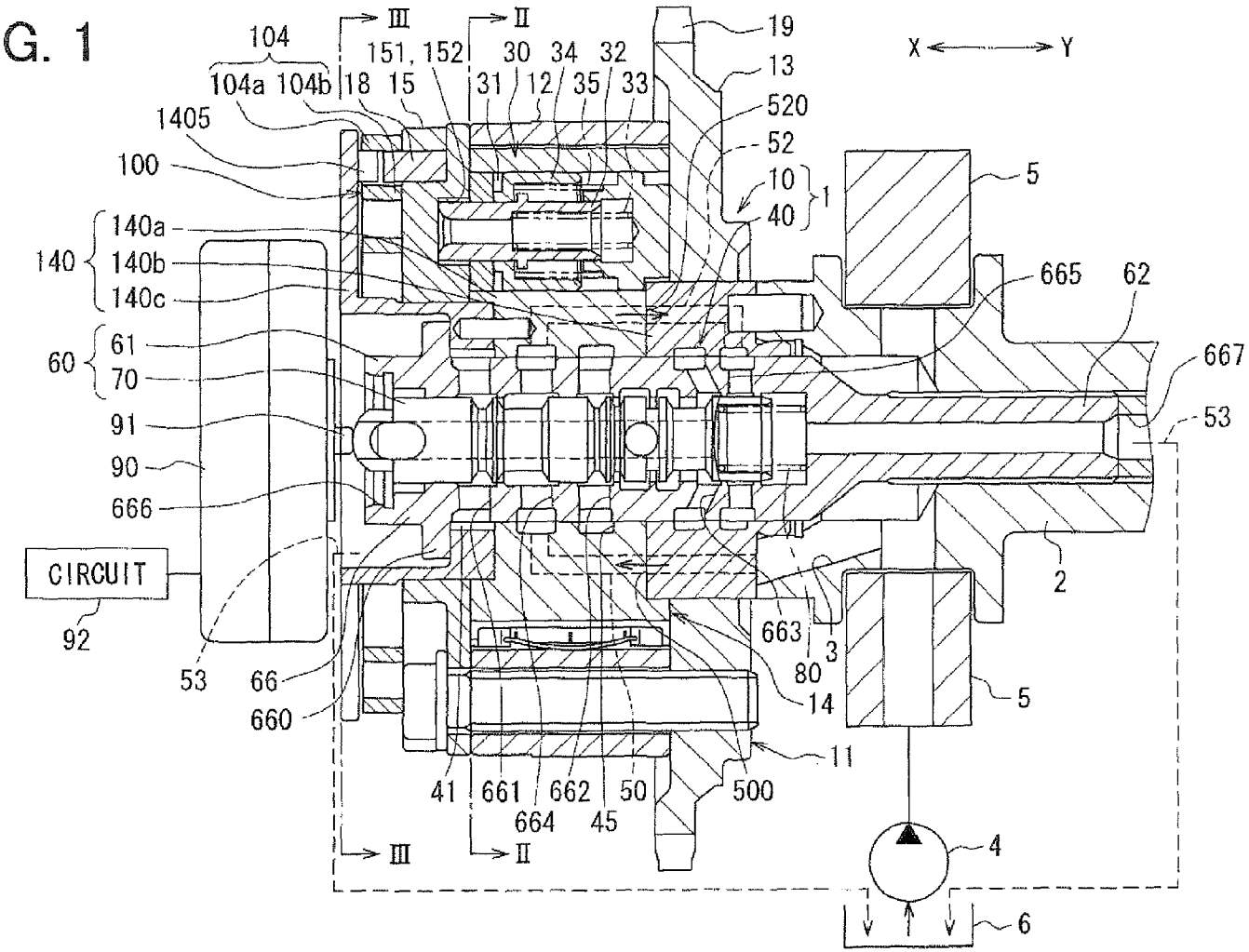
FIG. 1 is a sectional view showing a valve timing control apparatus according to a first embodiment.

As follows, embodiments will be described with reference to drawings. In the embodiments, an element described in a subsequent embodiment may be denoted with the same reference numeral, and description of such an element may be omitted. When only a part of a structure of an element is described in an embodiment, other part of the structure of the element may be equivalent to that of another foregoing embodiment. Combinations of elements are not limited to those specified in an embodiment. As long as a combination does not cause a defect, any combinations of elements and embodiments may be made.

First Embodiment

FIG. 1 shows an example in which a valve timing control apparatus 1 according to a first embodiment is applied to an internal combustion engine of a vehicle. FIG. 1 is a view taken along the line I-I in FIG. 2. The valve timing control apparatus 1 controls a valve timing of an intake valve, which functions as a valve train opened and closed by a camshaft 2, by using a working fluid. The valve timing control apparatus 1 includes an actuator portion 10 and a control portion 40.

The actuator portion 10 is provided to a transmission system, which transmits engine torque from a crankshaft ((not shown)) to the camshaft 2, and driven by the working fluid. The control portion 40 controls supply of the working fluid to the actuator portion 10.

(Actuator Portion)

First, the actuator portion 10 will be described in detail. In the actuator portion 10 shown in FIGS. 1, 2, a housing 11 is configured of a shoe housing 12, a sprocket 13, a front plate 15, and the like. The metallic shoe housing 12 includes a tubular housing body 120 and multiple shoes 121, 122, 123. The shoes 121, 122, 123 function as partitioning parts. The shoes 121, 122, 123 are projected to the radially inner side from portions of the housing body 120. The portions of the shoes 121, 122, 123 are spaced by a prescribed distance in a rotative direction of the housing body 120. Each of the shoes 121, 122, 123 has a projection side end, which is slidably in contact with an outer circumferential periphery of a rotation axis 140 of a vane rotor 14 via a sealing member. The shoes 121, 122, 123, which are adjacent to each other in the rotative direction, form an accommodation chamber 20 therebetween.

Both the sprocket 13 and the front plate 15 are formed of a metallic material to be in annular shapes and are coaxially fixed to both ends of the shoe housing 12. The sprocket 13 includes multiple teeth 19 projected radially outward. The sprocket 13 is connected with the crankshaft via a timing chain (not shown), which is meshed with the teeth 19. According to the present structure, engine torque is transmitted from the crankshaft to the sprocket 13 during an operation of the internal combustion engine. Thereby, the housing 11 rotates in the clockwise rotation of FIG. 2 with rotation of the crankshaft.

The metallic vane rotor 14 is accommodated coaxially in the housing 11. The metallic vane rotor 14 is slidably in contact with the sprocket 13 of the housing 11 and the front plate 15 at both sides in the axial direction. The vane rotor 14 includes a tubular rotation axis 140 and vanes 141, 142, 143.

The rotation axis 140 is coaxially fixed to the camshaft 2. In the present structure, the vane rotor 14 is rotatable in the clockwise rotation of FIG. 2 with rotation of the camshaft 2. In addition, the vane rotor 14 is rotatable relative to the housing 11. In the present embodiment, the rotation axis 140 includes a main body 140*a*, a boss 140*b*, and a bush 140*c*. The axial main body 140*a* has both ends fixed with the boss 140*b* and the bush 140*c*. The boss 140*b* extends through the sprocket 13 in the axial direction. The boss 140*b* is fixed to the camshaft 2 outside the housing 11. The bush 140*c* extends through the front plate 15 in the axial direction. The bush 140*c* opens to the outside of the housing 11. The camshaft 2 is rotatably supported by the bearing 5. The vanes 141, 142, 143 project radially outward from portions of the axial main body 140*a* of the rotation axis 140. The portions of the axial main body 140*a* are spaced by a prescribed distance in the rotative direction. The vanes 141, 142, 143 are respectively accommodated in corresponding accommodation chambers 20. Each of the vanes 141, 142, 143 has a projection side end, which is slidably in contact with an inner circumferential periphery of the housing body 120 via a sealing member.

The vanes 141, 142, 143 respectively partition the accommodation chambers 20 correspondingly to form advance chambers 22, 23, 24 and retard chambers 26, 27, 28 in the housing 11. An advance chamber 22 is formed between the shoe 121 and the vane 141. An advance chamber 23 is formed between the shoe 122 and the vane 142. An advance chamber 24 is formed between the shoe 123 and the vane 143. The advance chambers 22, 23, 24 are increased in volume when supplied with a working fluid. Thereby, the shoes 121, 122, 123 urge the vanes 141, 142, 143 in an advance direction. A retard chamber 26 is formed between the shoe 122 and the vane 141. A retard chamber 27 is formed between the shoe 123 and the vane 142. A retard chamber 28 is formed between the shoe 121 and the vane 143. The retard chambers 26, 27, 28 are increased in volume when supplied with a working fluid. Thereby, the shoes 121, 123, 121 urge the vanes 141, 142, 143 in a retard direction.

(Control Portion)

Figure 2:
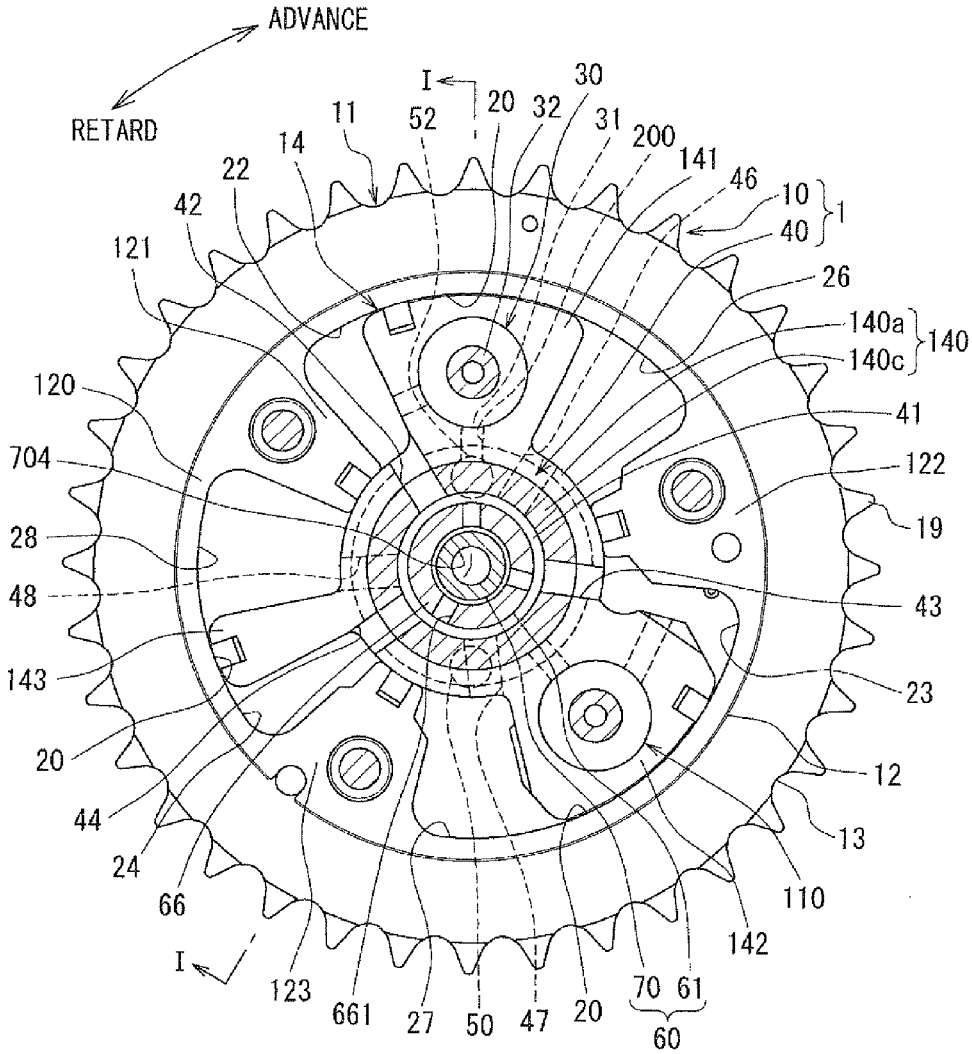
FIG. 2 is a sectional view showing an actuator portion, FIG. 2 being taken along the line II-II in FIG. 1.

As follows, the control portion 40 will be described in detail. As shown in FIG. 1 and FIG. 2, in the control portion 40, an advance main passage 41 is formed along the inner circumferential periphery of the bush 140*c* of the rotation axis 140. Advance branch passages 42, 43, 44 extend through the axial main body 140*a* and the bush 140*c* of the rotation axis 140. The advance branch passages 42, 43, 44 respectively communicate with the corresponding advance chambers 22, 23, 24 and a common advance main passage 41. A retard main passage 45 is defined by an annular groove opened in the inner circumferential periphery of the axial main body 140*a* of the rotation axis 140. The retard branch passages 46, 47, 48 extend through the axial main body 140*a* and respectively communicate with the corresponding retard chambers 26, 27, 28 and a common retard main passage 45. A lock passage 200 extends through the axial main body 140*a* and the boss 140*b* of the rotation axis 140 and communicates with a lock chamber 31.

The main supply passage 50 extends through the axial main body 140*a* and the boss 140*b* of the rotation axis 140. The main supply passage 50 communicates with a pump 4, which functions as a supply source, through a conveyance passage 3 of the camshaft 2. The main supply passage 50 is further connected to a main supply port 664. The main supply passage 50 branches to a sub-supply passage 52 at a branch portion 51, which is provided through the main supply passage 50. The sub-supply passage 52 is connected to a sub-supply port 665. The pump 4 is a mechanical pump driven by the crankshaft with a driving operation of an internal combustion engine. During an engine operation, the pump 4 regularly discharges a working fluid drawn from an oil sump 6.

A main check valve 500 having a valve element in a lead shape is provided to a portion of the main supply passage 50 on the side of the pump 4 from the branch portion 51. The main check valve 500 restricts a working fluid from flowing into the pump 4 from the main supply port 664. A sub-check valve 520 having a valve element in a lead shape is provided in the sub-supply passage 52. The sub-check valve 520 restricts a working fluid from flowing into the branch portion 51 from the sub-supply port 665. The conveyance passage 3 is regularly communicable with the outlet port of the pump 4 irrespective of rotation of the camshaft 2. Therefore, during an engine operation, the conveyance passage 3 regularly conveys a working fluid discharged from the pump 4 to the main supply passage 50.

An exhaust passage 53 connects with a discharge opening 666, a discharge opening 667, and the oil sump 6. The discharge opening 666 and the discharge opening 667 are provided as exhaust ports in both-ends of the control portion 40. The discharge opening 666 is located in an end of a sleeve portion 66 in a first direction X (one linearly movable direction of the sleeve 70). The discharge opening 667 is located in an end of the sleeve portion 66 in a second direction Y (other linearly movable direction of the sleeve 70). Both the discharge openings 666, 667 are communicated with a first drain port 704*a* and a second drain port 704*b*. Thereby, the exhaust passage 53 functions to discharge a working fluid from the inside of the spool 70 to the oil sump 6.

A control valve 60 is a spool valve accommodating a spool 70, which functions as a valve element, in a metallic valve body 61. The control valve 60 is coaxially accommodated in the rotation axis 140 of the vane rotor 14 and integrally rotatable with the rotation axis 140. The valve body 61 includes a stationary portion 62 and the sleeve portion 66, which are arranged in series in the axial direction. The stationary portion 62 is in a male-screw shape. The sleeve portion 66 is in a cylindrical shape having a closed end. The stationary portion 62 is screwed to the camshaft 2. Thereby, the stationary portion 62 fixes components 140*a*, 140*b*, 140*c* of the rotation axis 140 between a collar portion 660 and the camshaft 2. The collar portion 660 is defined by the peripheral wall of the sleeve portion 66. The sleeve portion 66 is located over the components 140*a*, 140*b*, 140*c* of the rotation axis 140 in the axial direction. The sleeve portion 66 opens at the discharge opening 666 to the inside of the bush 140*e*. The discharge opening 666 is located on the opposite side from the stationary portion 62 in the axial direction.

The sleeve portion 66 has multiple ports 661, 662, 663, 664, 665 each extending through the peripheral wall of the sleeve portion 66 in the radial direction. The multiple ports 661, 662, 663, 664, 665 are arranged at prescribed intervals in the axial direction. An advance port 661, which functions as an operation port, is most distant from the stationary portion 62 and communicated with the advance main passage 41. A retard port 662, which functions as an operation port, is located on the side of the stationary portion 62 from the advance port 661 and communicated with the retard main passage 45. A lock port 663 is located on the side of the stationary portion 62 from the retard port 662 and communicated with the lock passage 200. A main supply port 664, which functions as a supply port, is located between the advance port 661 and the retard port 662. The sub-supply port 665 is located on the side of the stationary portion 62 from the lock port 663. Both the main supply port 664 and the sub-supply port 665 communicate with the main supply passage 50. The discharge opening 666 is located in the end of the sleeve portion 66 in the first direction X. the discharge opening 667 is located in the end of the sleeve portion 66 in the second direction Y. The discharge opening 666 and the discharge opening 667 form an exhaust port communicated with the exhaust passage 53. The metallic spool 70 is formed in a cylindrical shape having a closed end. The metallic spool 70 has an opening toward the stationary portion 62. The metallic spool 70 is coaxially arranged inside the sleeve portion 66 and linearly movable in both axial directions.

(Operational Structure of Fluctuating Torque)

The actuator portion 10 is constructed by fixing the camshaft 2 to the rotation axis 140 of the vane rotor 14. During an operation of the internal combustion engine, fluctuating torque is caused in the actuator portion 10 by a spring counter force from the intake valve, which is opened and closed by the camshaft 2, and the like, and such fluctuating torque acts on the vane rotor 14. As exemplified in FIG. 4, fluctuating torque alternates between negative torque, which acts on the vane rotor 14 to the advance side relative to the housing 11, and positive torque, which acts on the vane rotor 14 to the retard side relative to the housing 11. In the present embodiment, in particular, a peak torque T+ of fluctuating torque on the positive side is greater than a peak torque T− of fluctuating torque on the negative side due to friction between the camshaft 2 and a bearing, and the like. Thus, an average torque Tave of the peak torque T+ and the peak torque T− is biased toward the positive side. Therefore, during an operation of an internal combustion engine, the vane rotor 14 is biased toward the retard side relative to the housing 11 on average by being applied with fluctuating torque transmitted from the camshaft 2.

(Biasing Structure)

Figure 3:
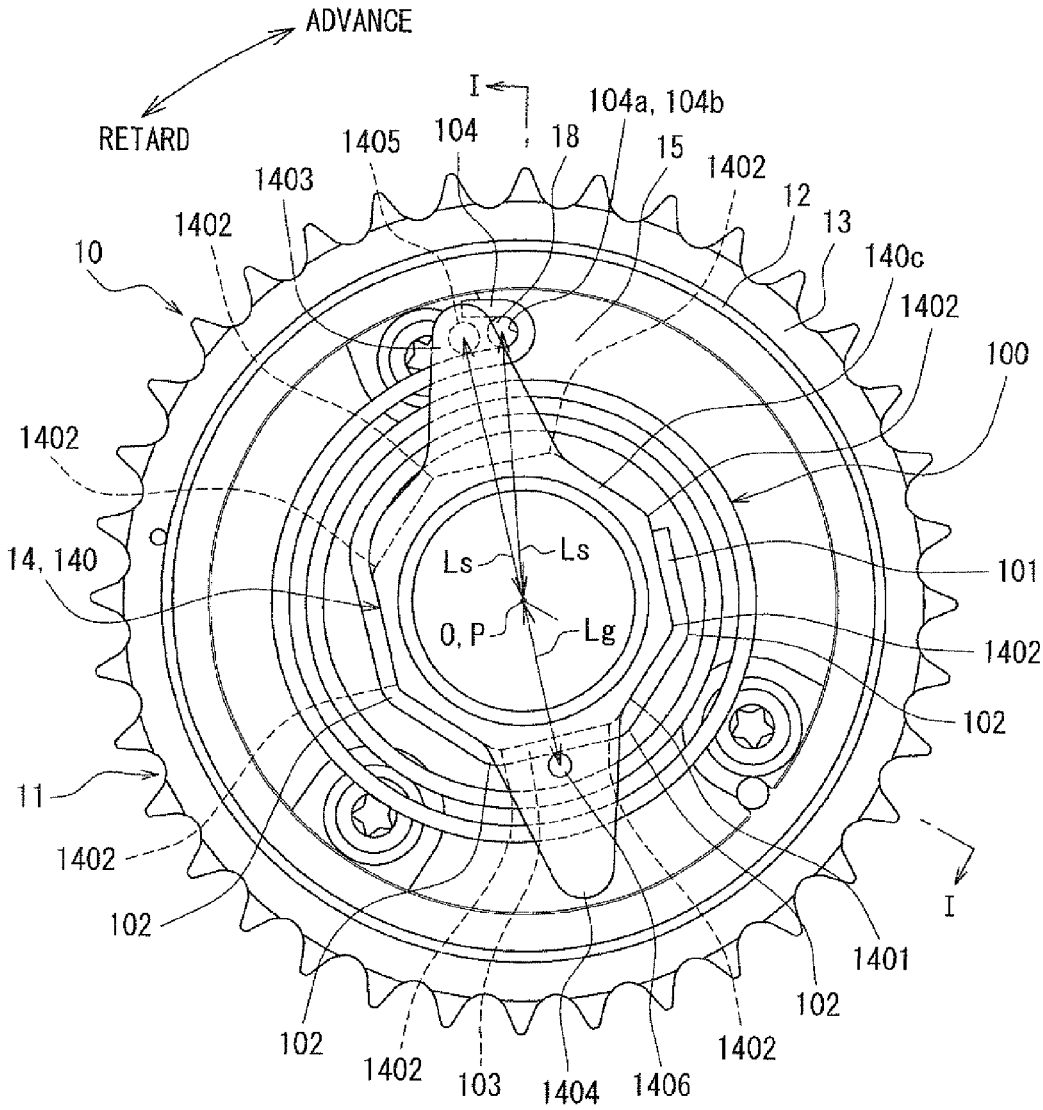
FIG. 3 is a sectional view showing the actuator portion, FIG. 3 being taken along the line III-III in FIG. 1.

In the actuator portion 10 shown in FIG. 1 and FIG. 3, the housing 11 is provided with a first metallic stopper 18, which is fixed to the front plate 15 and projected to the opposite side from the shoe housing 12. The first stopper 18 is a column-shaped pin projected along the axial direction of the rotation axis 140 from a position, which is distant from the rotation center O of the rotation axis 140 by a prescribed distance Ls. In FIG. 3, illustration of the control valve 60 is omitted to facilitate understanding of the drawing.

In the vane rotor 14, the bush 140*c* of the rotation axis 140 is projected from the front plate 15 to the opposite side from the shoe housing 12. The bush 140*c* has a right-octagonal-shaped outer periphery 1401 including eight corners 1402 each defining a bent outline along the rotative direction. The vane rotor 14 includes a pair of arms 1403, 1404 each being a plate-like member radially projected from the bush 140*c* in opposite directions. One arm 1403 is integrally formed with a second metallic stopper 1405, which is projected toward the front plate 15. The second stopper 1405 is a column-shaped pin projected along the axial direction of the rotation axis 140 from a position, which is distant from the rotation center O of the rotation axis 140 by the distance Ls, which is substantially the same as that of the first stopper 18. The second stopper 1405 does not overlap the first stopper 18 in the rotative direction of the rotation axis 140. The other arm 1404 is fixed with a metallic guide 1406, which is projected toward the front plate 15. The guide 1406 is a column-shaped pin projected along the axial direction of the rotation axis 140 from a position, which is distant from the rotation center O of the rotation axis 140 by a distance Lg. The distance Lg is smaller than the distance Ls in the case of the stoppers 18, 1405.

In the rotation axis 140, a metallic coil spring 100 is provided to the outer circumferential periphery of the bush 140*c* to function as an assisting spring. The coil spring 100 includes a noncontact balance spring substantially formed in a swirl-shape within a plane. The balance spring of the coil spring 100 includes wound wires, in which adjacent two wires are spaced from each other in the radial direction. The coil spring 100 has a swirl center P, which is aligned to the rotation center O of the rotation axis 140 and located between the front plate 15 and the arm 1403, 1404.

The coil spring 100 has an innermost periphery portion 101, which includes a bent portion in an angular range of at least 180 degrees along the rotative direction of the rotation axis 140. The bent portion of the coil spring 100 is bent to be in a shape along the outer periphery 1401 of the bush 140*c* to include four bent portions 102. Each bent portion 102 is fitted to the corresponding corner 1402 of the outer periphery 1401 of the bush 140*c*. In the present structure, the innermost periphery portion 101 of the coil spring 100 is wound around the bush 140*c* along the rotative direction over the four corners 1402 formed in the angular range of at least 180 degrees. Thus, the innermost periphery portion 101 is retained to both sides in the rotative direction by the rotation axis 140. Further, the innermost periphery portion 101 of the coil spring 100 includes a linear portion 103 between the second bent portion 102, which is the second from the tip end, and the third bent portion 102, which is the third from the tip end. The linear portion 103 is interposed between the guide 1406 and the outer periphery 1401 of the bush 140*c*. In the present structure, displacement of the retaining portion of the innermost periphery portion 101 of the coil spring 100 relative to the rotation axis 140 is restricted. Therefore, in the present embodiment, the coil spring 100 need not be seized to the rotation-axis 140 by welding, adhesion, or the like. Alternatively, the coil spring 100 may be seized to the rotation-axis 140.

The coil spring 100 has an outermost periphery portion 104 located on the radially outer side of the innermost periphery portion 101. The outermost periphery portion 104 is bent or curved to be in a U-shape to form retaining portions 104*a* and 104*b*. The retaining portions 104*a* and 104*b* are located to be distant from the rotation center O of the rotation axis 140 by the distance Ls, which is substantially the same as that in the cases of the stoppers 18, 1405.

Referring to FIG. 1 and FIG. 3, the first retaining portion 104*b* of the outermost periphery portion 104 is located on the side of the front plate 15 in the axial direction of the rotation axis 140. The first retaining portion 104*b* is in a U-shape to open toward the retard side relative to the housing 11 in the rotative direction of the rotation axis 140. When the rotation phase is on the retard side relative to a starting phase (regulation phase), the first stopper 18 is pinched by the first retaining portion 104*b* in the radial direction of the rotation axis 140, and the first retaining portion 104*b* is retained by the first stopper 18. Thereby, the position of the first retaining portion 104*b* is regulated such that the first retaining portion 104*b* is not displaced to the radially inside.

Referring to FIG. 1 and FIG. 3, the second retaining portion 104*a* is provided to the outermost periphery portion 104. The second retaining portion 104*a* is shifted toward the arm 1403 from the first retaining portion 104*b* in the axial direction of the rotation axis 140. The second retaining portion 104*a* is in a U-shape to open toward the retard side relative to the housing 11 in the rotative direction of the rotation axis 140. When the rotation phase is on the advance side relative to a starting phase (regulation phase), the second stopper 1405 is pinched by the second retaining portion 104*a* in the radial direction of the rotation axis 140, and the second retaining portion 104*a* is retained by the second stopper 1405. Thereby, the position of the second retaining portion 104*a* is regulated such that the second retaining portion 104*a* is not displaced radially inward.

In the present bias structure, when the rotation phase changes to the retard side beyond the starting phase (regulation phase), the coil spring 100, which is retained by the rotation axis 140 of the vane rotor 14 at the innermost periphery portion 101, is further retained by the first stopper 18 of the housing 11 at the first retaining portion 104*b* of the outermost periphery portion 104. In the present condition, the second stopper 1405 of the vane rotor 14 moves away from the second retaining portion 104*a* of the outermost periphery portion 104 of the coil spring 100 toward the retard side. Thereby, the rotation axis 140, i.e., a vane rotor 14*a* is biased from the coil spring 100 toward the advance side.

On the other hand, when the rotation phase changes to the advance side beyond the starting phase (regulation phase), the coil spring 100, which is retained by the rotation axis 140 at the innermost periphery portion 101, is further retained by the second stopper 1405 at the second retaining portion 104*a* of the outermost periphery portion 104. In the present condition, the first retaining portion 104*b* of the outermost periphery portion 104 of the coil spring 100 moves away from the first stopper 18 toward the advance side. Thereby, the coil spring 100 is prohibited from biasing the vane rotor 14.

In the present structure, on the retard side beyond the starting phase (regulation phase), the coil spring 100, which is retained by the first stopper 18 of the housing 11 and the rotation axis 140 of the vane rotor 14, biases the vane rotor 14 toward the advance side in opposition to fluctuating torque, which acts toward the retard side on average. Contrary, on the advance side beyond the starting phase (regulation phase), the coil spring 100 is retained by the second stopper 1405 and the rotation axis 140 of the vane rotor 14. Thereby, the vane rotor 14 is biased toward the retard side by fluctuating torque acting toward the retard side on average. In the present structure, the rotation phase can be changed from both the advance side and the retard side toward the regulation phase on stop of the internal combustion engine. Thereby, a locking performance at the regulation phase can be enhanced. Thus, the rotation phase can be maintained at the regulation phase in starting of the internal combustion engine, and an engine starting property can be secured.

Furthermore, the coil spring 100 biases the vane rotor toward the advance side in opposition to fluctuating torque by applying a biasing force, which is greater than average fluctuating torque eccentrically acting toward the retard side on average. Therefore, on the retard side beyond the regulation phase, the rotation phase can be changed to the regulation phase by applying the biasing force of the coil spring 100 on stop of the internal combustion engine. Contrary, on the advance side beyond the regulation phase, the rotation phase can be changed to the regulation phase on stop of the internal combustion engine by utilizing a fluctuating torque eccentrically acting toward the retard side. In the present structure, the locking performance at the regulation phase can be enhanced. Thus, the rotation phase can be maintained at the regulation phase at the time of starting of the internal combustion engine. Thereby, the engine starting property can be secured.

Furthermore, the innermost periphery portion 101 of the coil spring 100 is retained by the bush 140*c* of the rotation axis 140 of the vane rotor 14 such that the innermost periphery portion 101 is wound around the bush 140*c* in the rotative direction. Therefore, the innermost periphery portion 101 is hard to deform with relative rotation of the vane rotor 14 to the housing 11. In particular, the innermost periphery portion 101 is wound around the outer periphery 1401 of the bush 140*c* over the four corners 1402 in the angular range of at least 180 degrees along the rotative direction. Therefore, the shape of the innermost periphery portion 101 is stabilized, and deviation in the stop position is regulated. Further, the innermost periphery portion 101 is wound to encompass the four corners 1402 and interposed between the bush 140*c* and the guide 1406. Thereby, deviation of the retaining position is further enhanced. In the present structure, friction caused by sliding between the innermost periphery portion 101 and the bush 140*c* can be restricted when the vane rotor 14 rotates toward the retard side relative to the housing 11 and when the vane rotor 14 rotates toward the advance side relative to the housing 11. That is, friction can be restricted when the rotation phase is changed toward the retard side and the advance side.

In addition, the coil spring 100, which includes the balance spring, can maintain its shape in which adjacent wires are radially spaced from each other even when being twisted due to relative rotation between the vane rotor 14 and the housing 11. Further, the outermost periphery portion 104 of the coil spring 100 is retained by the stoppers 18, 1405 respectively at the retaining portions 104*a*, 104*b*. Thereby, displacement of the outermost periphery portion 104 toward the radially inside can be regulated irrespective of the rotation phase. Thus, the space between adjacent wires of the coil spring 100 can be maintained irrespective of the rotation phase. In the present structure, friction between adjacent wires of the coil spring 100 can be restricted when the rotation phase is changed toward the retard side and the advance side.

(First Regulating and Locking Structure)

Figure 6:
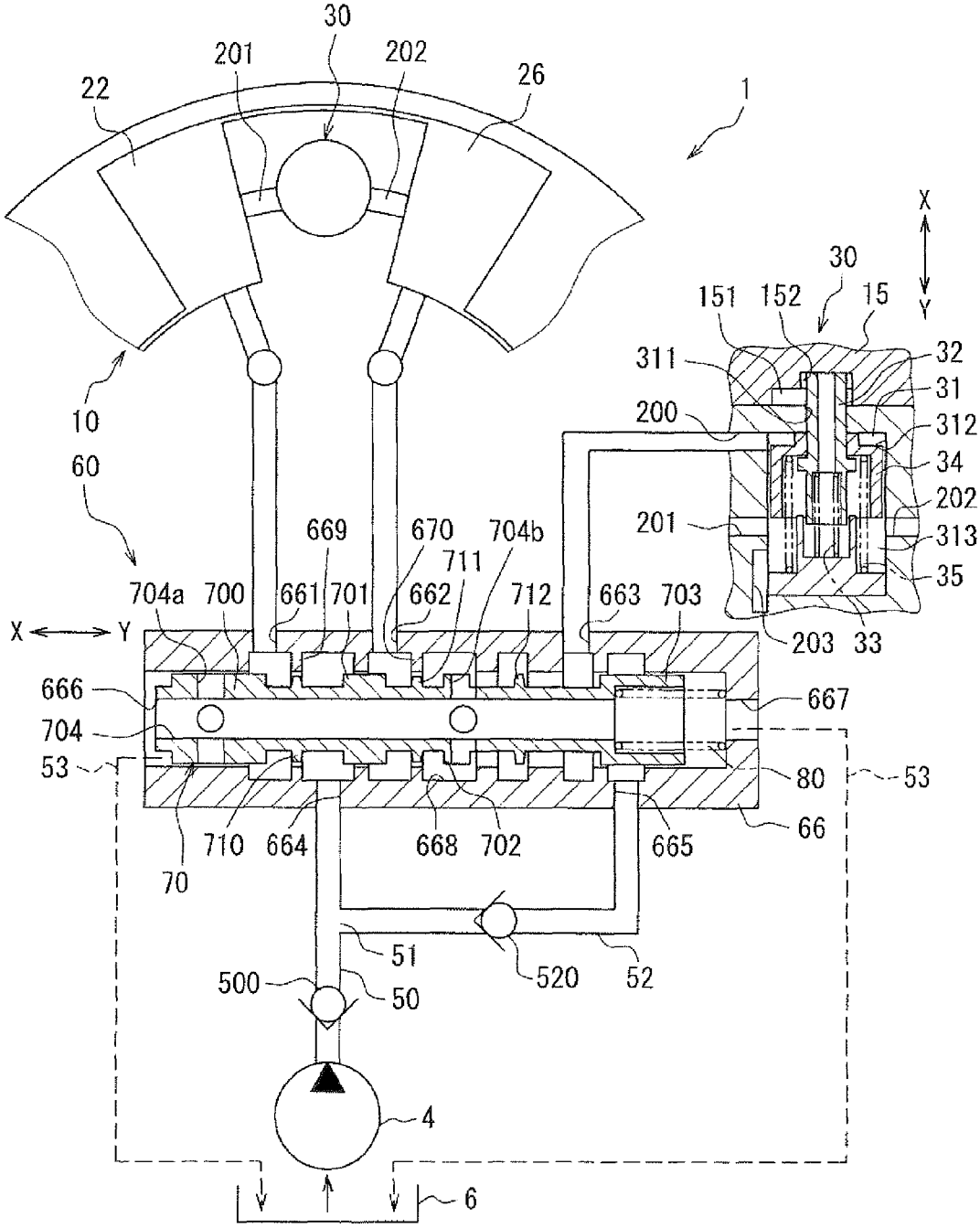
FIG. 6 is an enlarged sectional view showing a main component of the control portion shown in FIG. 1.

Subsequently, a phase lock portion 30 of the present embodiment will be described. As shown in FIGS. 1, 6, 7, a first regulating recess portion 151 and a locking recess portion 152 are formed on the front plate 15. The first regulating recess portion 151 is opened in the inner surface of the front plate 15 and extended in the rotative direction of the housing 11. The first regulating recess portion 151 has both closed ends defining a pair of regulation stoppers 151*a* and 151*b*. The locking recess portion 152 is a bottomed cylindrical hole in parallel with the axis of the camshaft 2.

A first accommodating bore 310 is formed in the vane 141. A first accommodation hole 310 is a bottomed cylindrical hole in parallel with the axis of the camshaft 2. The first accommodation hole 310 is opened in a slide-contact end surface of the vane rotor 14 opposed to the inner surface of the front plate 15. A first main regulating member 32, a first main resilient member 33, a sub-regulating member 34, and a sub-resilient member 35 are located in the first accommodation hole 310. The first main regulating member 32 includes a metallic inner pin. The first main resilient member 33 includes a metallic compression coil spring having resilience when elastically deformed to bias the first main regulating member 32 toward the front plate 15. The first sub-regulating member 34 includes a metallic outer pin in which the first main regulating member 32 is slidable. The first sub-resilient member 35 includes a metallic compression coil spring having resilience when being elastically deformed to bias the first sub-regulating member 34 toward the front plate 15.

A small-diameter supporting portion 311 partially defines the first accommodation hole 310 on the opening side of the front plate 15 in which the recess portions 151, 152 are formed. The small-diameter supporting portion 311 is opposed to the first regulating recess portion 151 and the locking recess portion 152 respectively in prescribed rotation phases. In the present embodiment, the small-diameter supporting portion 311 is defined by a small-diameter inner circumferential periphery formed in the vane 141 on the side of the front plate 15. The first accommodation hole 310 includes a large-diameter supporting portion 312, which is larger in the diameter than the small-diameter supporting portion 311. The large-diameter supporting portion 312 is formed in a bottom surface on the opposite side of the front plate 15, which has the recess portions 151, 152.

The large-diameter supporting portion 312 has an end on the side of the front plate 15, and the end regularly communicates with the lock passage 200, which extends through the vane rotor 14, thereby to form the lock chamber 31. The lock chamber 31 is capable of being supplied with a working fluid and capable of discharging a working fluid. The lock chamber 31 is an annular space formed between an end surface 311*a* of the small-diameter supporting portion 311 on the opposite side of the front plate 15 and an outer surface of the first sub-regulating member 34 on the side of the front plate 15. An advance communication passage 201 and a retard communication passage 202 are formed in the large-diameter supporting portion 312 on the opposite side of the front plate 15. The advance communication passage 201 and the retard communication passage 202 extend through the vane rotor 14. The advance communication passage 201 is connected with the advance chamber 22. The retard communication passage 202 is connected with the retard chamber 26.

An end of the large-diameter supporting portion 312 on the opposite side from the front plate 15 and an inner surface of the first sub-regulating member 34, which is slidably fitted in the large-diameter supporting portion 312, form a communication chamber 313. The communication chamber 313 is communicable with the advance communication passage 201 and the retard communication passage 202 when the first sub-regulating member 34, which is slidable in the large-diameter supporting portion 312, is in a prescribed sliding position range. The vane 141 has an air hole 203, which is opened in the inner surface of the large-diameter supporting portion 312 to communicate with the outside of the large-diameter supporting portion 312 and configured to receive and discharge external air. The air hole 203 may have a passage sectional area greater than passage sectional areas of the advance communication passage 201 and the retard communication passage 202.

The first accommodation hole 310 coaxially accommodates metallic tubular regulating members 32 and 34. The first main regulating member 32 is supported by the small-diameter supporting portion 311 at the outer periphery thereby movable in the axial direction. A substantially center portion of the first main regulating member 32 in the axial direction has an annular projection (fitted portion) 320, which is projected radially outward. The first main regulating member 32 has an inner circumferential periphery defining a through-hole 321, which regularly communicates the side of the front plate 15 with the opposite side from the front plate 15.

Figure 7A:
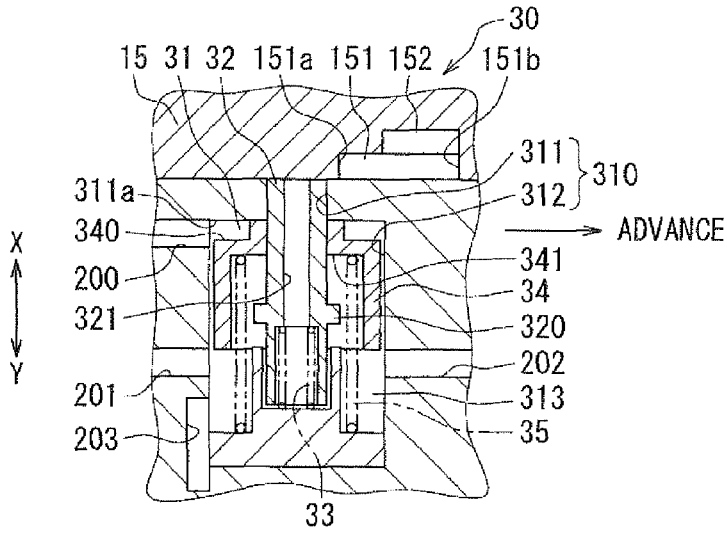
FIGS. 7A to 7C are sectional views each showing a lock unit shown in FIG. 1.
Figure 7B:
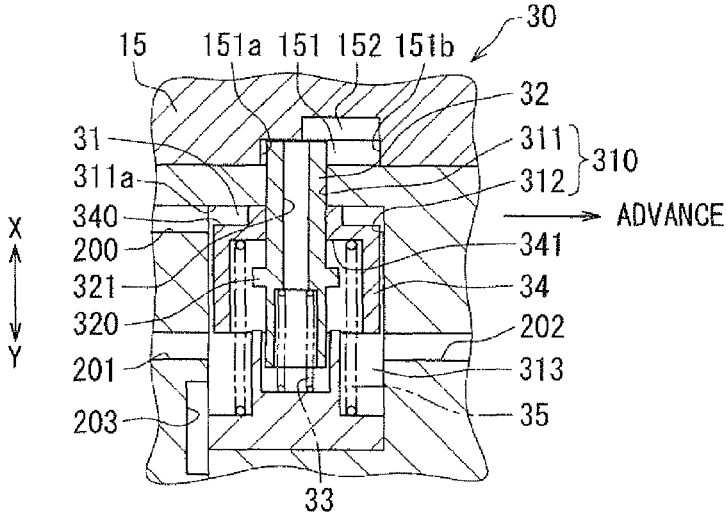

As shown in FIG. 7B, the first main regulating member 32 moves in a thrust direction X when being in a region of the regulation phase including the lock phase, thereby thrusting into the first regulating recess portion 151 of the housing 11. In this manner, as shown in FIG. 7B, the first main regulating member 32, which thrusts into the first regulating recess portion 151, is retained by the regulation stopper 151*a* defined by the end of the first regulating recess portion 151 on the retard side. Thereby, change in the rotation phase toward the retard side is regulated at a first regulation phase, which is a limit of a regulation phase region on the retard side. On the other hand, the first main regulating member 32, which thrusts into the first regulating recess portion 151, is retained by the regulation stopper 151*b* defined by an end of the first regulating recess portion 151 on the advance side. Thereby, change in the rotation phase on the advance side is regulated in a lock phase.

Figure 7C:
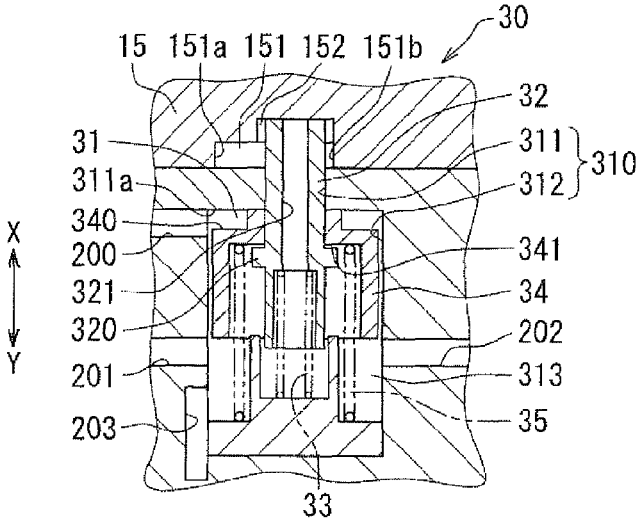

As shown in FIG. 7C, the first main regulating member 32 moves in the thrust direction X when being in the lock phase, thereby thrusting into the locking recess portion 152 of the housing 11. The first main regulating member 32 thrusting into the locking recess portion 152 in this way is fitted with the locking recess portion 152. Thereby, the first main regulating member 32 regulates change in the rotation phase on both the advance side and the retard side to lock the rotation phase in the lock phase.

Figure 9:
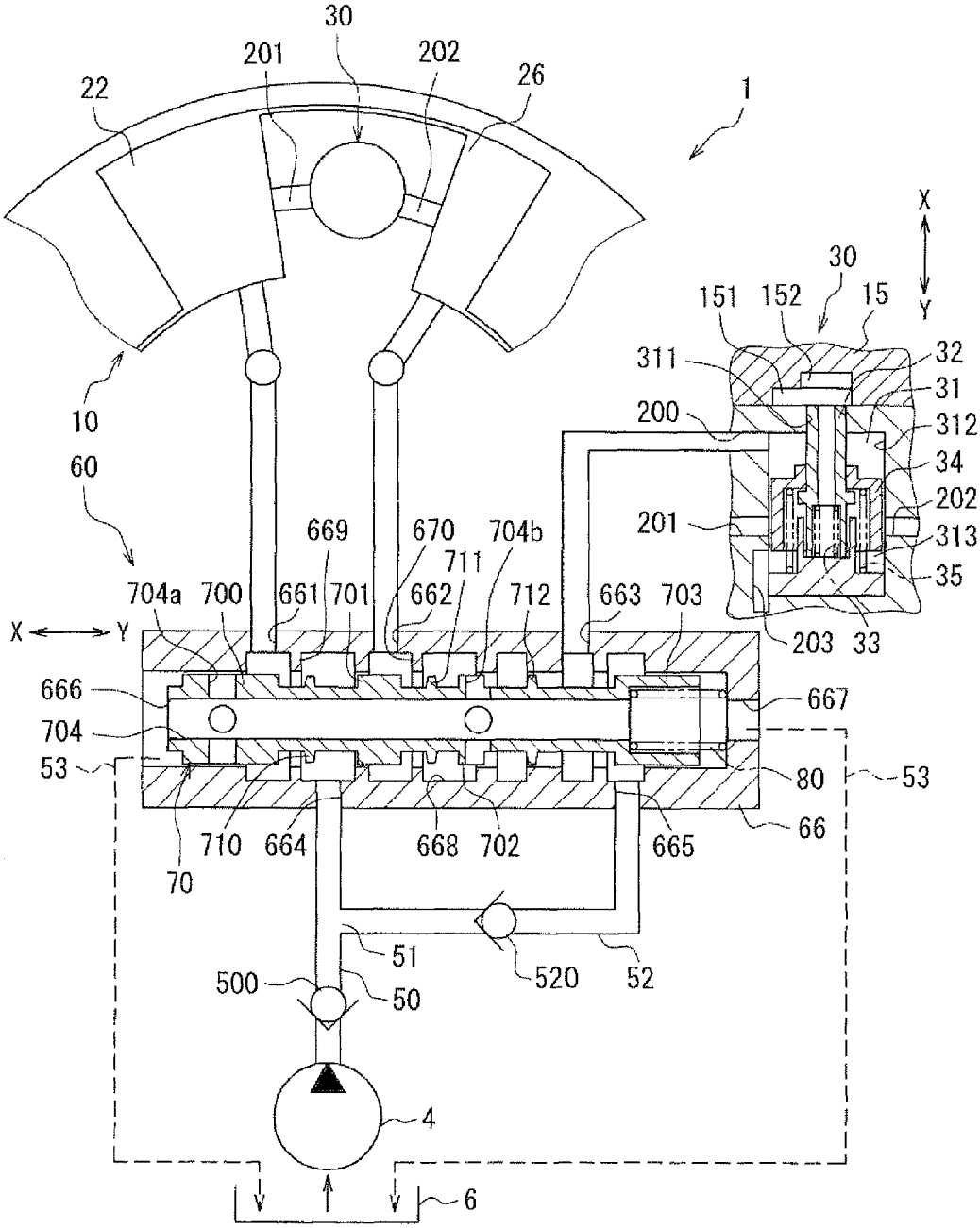
FIG. 9 is an enlarged sectional view showing the main component in an operational state different from those in FIGS. 6, 8.
Figure 10:
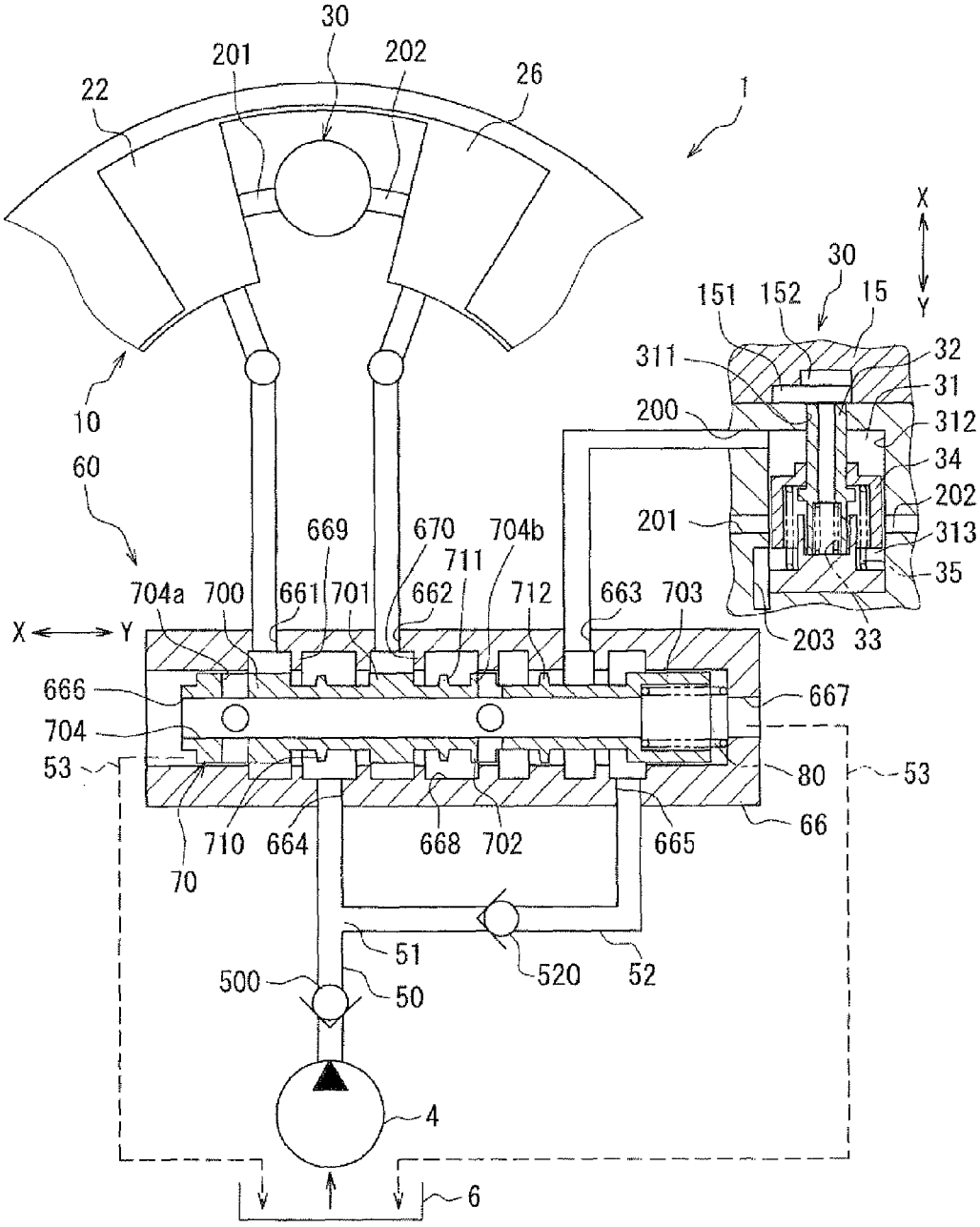
FIG. 10 is an enlarged sectional view showing the main component in an operational state different from those in FIGS. 6, 8, 9.
Figure 11:
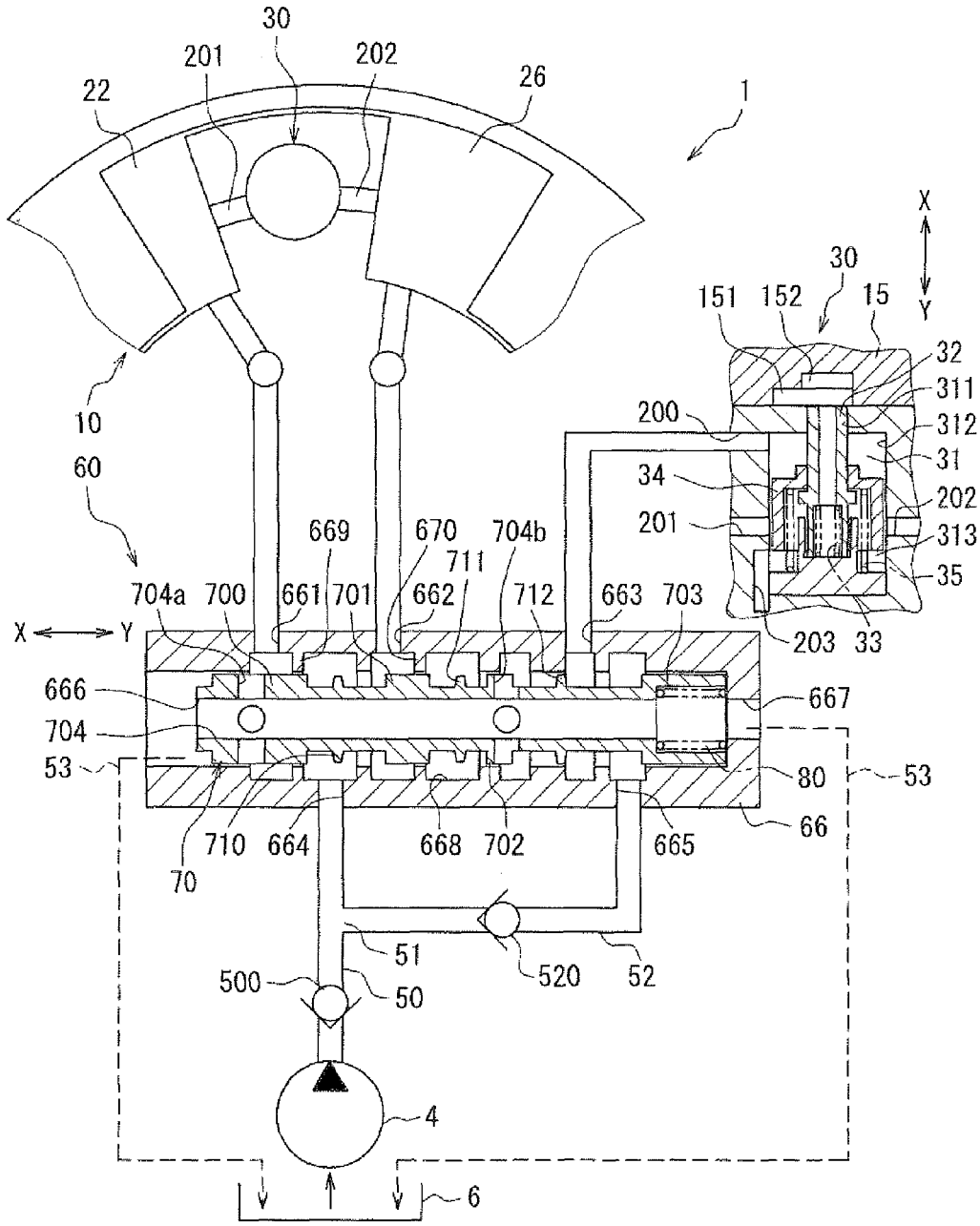
FIG. 11 is an enlarged sectional view showing the main component in an operational state different from those in FIGS. 6, 8 to 10.

Further, as shown in FIGS. 9 to 11, the first main regulating member 32 moves in a retract direction Y when being in the regulation phase region including the lock phase. Thereby, the first main regulating member 32 is retracted from both the locking recess portion 152 and the first regulating recess portion 151 of the housing 11. In this manner, the first main regulating member 32 is retracted from the recess portions 152, 151, thereby to cancel regulation of the rotation phase so as to allow arbitrary change in the rotation phase.

Contrary to the first main regulating member 32, the first sub-regulating member 34 is fitted, not to the small-diameter supporting portion 311 of the first accommodation hole 310, but to the outer periphery of the first main regulating member 32 on the side of the large-diameter supporting portion 312. Further, the first sub-regulating member 34 is supported by the large-diameter supporting portion 312 at the outer periphery. In such a fitting and supporting structure, the first sub-regulating member 34 is movable in the axial direction same as the movable direction in the case of the first main regulating member 32. Further, the first sub-regulating member 34 is movable relative to the first main regulating member 32.

The first sub-regulating member 34 is exposed to the lock chamber 31. The first sub-regulating member 34 has an annular end surface on the side of the front plate 15, and the annular end surface functions as a pressure-receiving portion 340 (FIGS. 7A to 7C), which opposes to the end surface 311*a* of the small-diameter supporting portion 311. The end surface 311*a* is on the opposite side from the front plate 15. The pressure-receiving portion 340 receives pressure of a working fluid in the lock chamber 31 in the retract direction Y, thereby generating driving force to drive the first sub-regulating member 34 in the retract direction Y.

The first sub-regulating member 34 has an annular surface on the opposite side from the front plate 15. The annular surface of the first sub-regulating member 34 is exposed to the communication chamber 313 to function as a fitted portion 341, which is opposed to a bottom surface of the large-diameter supporting portion 312. As shown in FIGS. 9 to 11, in a state where the fitted portion 341 is fitted to (in contact with) the projection 320 in the retract direction Y, the fitted portion 341 transmits driving force caused by the first sub-regulating member 34 to the first main regulating member 32. Thereby, the fitted portion 341 is capable of driving the regulating members 32 and 34 integrally in the retract direction Y.

Figure 8:
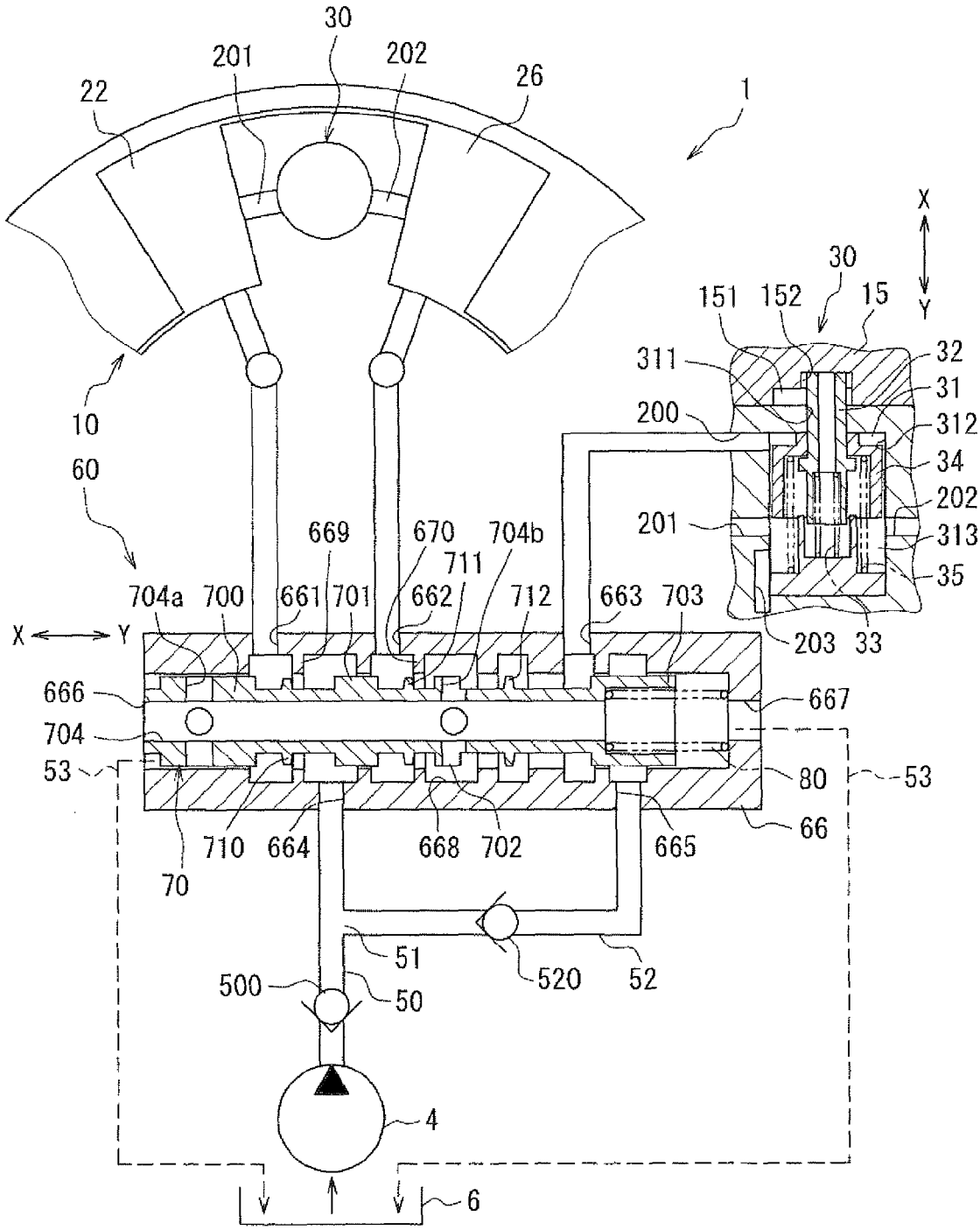
FIG. 8 is an enlarged sectional view showing the main component in an operational state different from that in FIG. 6.

Further, the end of the first sub-regulating member 34 in the retract direction Y moves in the thrust direction X beyond a blockade position at which the advance communication passage 201, the retard communication passage 202, and the communication chamber 313 are blocked from each other. In this case, as shown in FIGS. 6 to 8, the advance communication passage 201, the retard communication passage 202, and the communication of the communication chamber 313 are communicated with each other. In addition, the advance communication passage 201 and the retard communication passage 202 are communicated with the air hole 203 through the communication chamber 313.

The resilient members 33 and 35 are coaxially accommodated in a portion of the first accommodation hole 310, which includes at least the communication chamber 313. The first main resilient member 33 is interposed between the bottom surface defining the first accommodation hole 310 and located on the opposite side from the front plate 15 and the first main regulating member 32. The first main resilient member 33 causes first main resilience when compressed between the surface of the first accommodation hole 310 and the first main regulating member 32, thereby to bias the first main regulating member 32 in the thrust direction X. In the present structure, the first main resilience of the first main resilient member 33 is applied to thrust the first main regulating member 32 in the thrust direction X when being out of the regulation phase region including the most retard phase. Thereby, as shown in FIG. 7A, the first main regulating member 32 can be in contact with the inner surface of the front plate 15. Further, as shown in FIGS. 9 to 11, in a state where the fitted portion 341 is fitted to the projection 320, the first main regulating member 32 and the first sub-regulating member 34 can be integrally driven to thrust in the thrust direction X when being applied with the first main resilience of the first main resilient member 33.

Contrary to the first main resilient member 33, the first sub-resilient member 35 is interposed between the bottom surface defining the first accommodation hole 310 and located on the opposite side from the front plate 15 and the first sub-regulating member 34. The first sub-resilient member 35 causes first sub-resilience when compressed between the surface of the first accommodation hole 310 and the first sub-regulating member 34, thereby to bias the first sub-regulating member 34 in the thrust direction X. In the present structure, as shown in FIG. 7A, in a state where the first main regulating member 32 is in contact with the inner surface of the front plate 15 when being out of the regulation phase region, the fitted portion 341 can be spaced from the projection 320 in the thrust direction X by applying the first sub-resilience of the first sub-resilient member 35 only to the first sub-regulating member 34. As show in FIG. 7A, the fitted portion 341 is spaced from the projection 320 by applying the first sub-resilience from the first sub-resilient member 35. In the present condition, the end of the first sub-regulating member 34 on side of the front plate 15 can be made in contact with the end surface 311*a* of the small-diameter supporting portion 311.

In the present structure, as shown in FIG. 7C, the rotation phase of the vane rotor 14 relative to the housing 11 is maintained in the actuator portion 10 when the first main regulating member 32 is locked by being fitted into the locking recess portion 152. On the contrary, as shown in FIGS. 9 to 11, when the first main regulating member 32 is retracted from the locking recess portion 152 and the first regulating recess portion 151 to release the lock, a working fluid is supplied into the advance chambers 22, 23, 24, and a working fluid is discharged from the retard chambers 26, 27, 28. Thereby, the rotation phase changes toward the advance side, and the valve timing is advanced. When the lock is released, a working fluid is supplied into the retard chambers 26, 27, 28, and a working fluid is discharged from the advance chambers 22, 23, 24. Thereby, the rotation phase changes toward the retard side, and the valve timing is retarded.

In the present embodiment, the elements 30, 31, 32, 33,151,152 function as a lock unit.

(Second Regulation Structure)

The vane 142 of the vane rotor 14 and the front plate 15 located at a corresponding position are provided with a second regulation structure 110, which is similar to the above-described first regulation structure. In the regulation phase region, the second regulation structure 110 regulates the regulation phase from changing toward the retard side when being in the rotation phase (second regulation phase, third regulation phase) on the advance side beyond the first regulation phase. Subsequently, a difference of the second regulation structure from the first regulation structure will be described.

The vane 142 has a first accommodation hole in which a second main regulating member, a second main resilient member, a second sub-regulating member, and a second sub-resilient member are provided. The second main regulating member, the second main resilient member, the second sub-regulating member, and the second sub-resilient member are similar to corresponding elements in the first regulation structure. A second regulating recess portion is formed in the front plate 15. The second regulating recess portion opens in the inner surface of the front plate 15 and extends in the rotative direction of the housing 11. The second regulating recess portion is further dented by one step toward the advance side from the retard side to have a narrow bottom portion and a deep bottom portion. Regulation stoppers are respectively provided to closed ends of the narrow bottom portion and the deep bottom portion of the second regulating recess portion on the retard side.

The second main regulating member moves to the thrust direction X when being in the regulation phase region including the lock phase, thereby to thrust into the narrow bottom portion on the retard side or the deep bottom portion on the advance side of the second regulating recess portion. In the present structure, the second main regulating member thrusts into the narrow bottom portion to be retained by the regulation stopper on the retard side end of the narrow bottom portion. Thereby, the second main regulating member regulates the rotation phase from being changed to the retard side when being in the second regulation phase on the advance side relative to the first regulation phase in the regulation phase region. Alternatively, the second main regulating member thrusts into the deep bottom portion to be retained by the regulation stopper on the retard side end of the deep bottom portion. Thereby, the second main regulating member regulates the rotation phase from being changed to the retard side when being in the third regulation phase on the advance side relative to the second regulation phase and on the retard side relative to the lock regulation phase in the regulation phase region. Furthermore, the second main regulating member moves in the retract direction Y when being in the regulation phase region including the lock phase, and thereby the second main regulating member is retracted from the second regulating recess portion. In this manner, the second main regulating member is retracted from the second recess portion, thereby to cancel regulation of the rotation phase so as to allow arbitrary change in the rotation phase.

As follows, a structure of the spool 70 will be described in detail. The spool 70 has multiple annular lands 700, 701, 702, 703 formed to be slidable relative to the inner circumferential periphery of the sleeve portion 66. The lands 700, 701, 702, 703 are arranged in the axial direction and spaced by prescribed distances. The advance land 700 is most spaced from the stationary portion 62. The advance land 700 is supported by the sleeve portion 66. The advance land 700 is located in at least one of a space between the advance port 661 and the discharge opening 666 and a space between the advance port 661 and the main supply port 664 according to the movable position of the spool 70. The retard land 701 is located on the side of the stationary portion 62 from the advance land 700. The retard land 701 is also supported by the sleeve portion 66. The retard land 701 is located in at least in one of a space between the retard port 662 and the main supply port 664 and a space between the retard port 662 and the lock port 663 according to the movable position of the spool 70.

The first lock land 702 is located on the side of the stationary portion 62 from the retard land 701. The first lock land 702 is supported by the sleeve portion 66. The first lock land 702 is movable around a space between the lock port 663 and the retard port 662 according to the movable position of the spool 70. The first lock land 702 may be in a state where the first lock land 702 is not supported by the sleeve portion 66, according to the movable position of the spool 70, due to existence of an annular groove 668 opening from the inner circumferential periphery of the sleeve portion 66. The second lock land 703 is located on the side of the stationary portion 62 from the first lock land 702. The second lock land 703 is supported by the sleeve portion 66. The second lock land 703 is movable between the sub-supply port 665 and the lock port 663 according to the movable position of the spool 70. The second lock land 703 is supported by the sleeve portion 66. The second lock land 703 is located between the sub-supply port 665 and the stationary portion 62 irrespective of the movable position of the spool 70.

The spool 70 has a communication passage 704 therein. The communication passage 704 has the first drain port 704*a* located in the advance land 700. The first drain port 704*a* is opened in the outer periphery of the spool 70. The exhaust passage 53 is communicated with the first drain port 704*a* irrespective of the movable position of the spool 70. The communication passage 704 is communicable with the advance port 661 through the first drain port 704*a* according to the movable position of the spool 70. The first drain port 704*a* functions as an advance drain port to discharge a working fluid from the advance chambers 22, 23, 24 to the passage 53 according to the movable position of the spool 70.

The communication passage 704 further has the second drain port 704*b* located in the first lock land 702. The second drain port 704*b* opens in the outer periphery of the spool 70. The communication passage 704 is communicable with one of the retard port 662 and the lock port 663 through the second drain port 704*b* according to the movable position of the spool 70. The second drain port 704*b* functions as an exhaust retard drain port to discharge a working fluid from the retard chambers 26, 27, 28 to the passage 53 according to the movable position of the spool 70. The second drain port 704*b* further functions as an exhaust pin drain port to discharge a working fluid from the lock chamber 31 to the exhaust passage 53 through the lock passage 200 and the lock port 663.

An annular first throttle portion 710 is provided between the advance land 700 and the retard land 701. The first throttle portion 710 is projected in the radial direction from the outer periphery of the spool 70. The first throttle portion 710 forms a throttle passage with a corresponding inner periphery of the sleeve portion 66. The first throttle portion 710 has a function to control a flow of a circulating working fluid by applying a flow resistance when the working fluid circulates through the throttle passage in the axial direction of the spool 70. The first throttle portion 710 is configured to form an advance supply throttle passage through which a working fluid circulates from the main supply port 664 to the advance port 661. The first throttle portion 710 functions as an advance supply throttle portion configured to control a flow of a working fluid circulating through the advance supply throttle passage and control a flow of a working fluid supplied to the advance chambers 22, 23, 24 according to the movable position of the spool 70.

An annular second throttle portion 711 is provided between the retard land 701 and the first lock land 702. The second throttle portion 711 is projected in the radial direction from the outer periphery of the spool 70. The second throttle portion 711 forms a throttle passage with a corresponding inner periphery of the sleeve portion 66. The second throttle portion 711 has a function to control a flow of a circulating working fluid by applying a flow resistance when the working fluid circulates through the throttle passage in the axial direction of the spool 70. The second throttle portion 711 is configured to form a retard drain throttle passage through which a working fluid circulates from the retard port 662 to the second drain port 704*b*. The second throttle portion 711 functions as a retard drain throttle portion configured to control a flow of a working fluid circulating through the retard drain throttle passage and control a flow of a working fluid drained from the retard chambers 26, 27, 28 to the exhaust passage 53 according to the movable position of the spool 70.

The first throttle portion 710 and the second throttle portion 711 form the throttle passage. A first sleeve side projection 669 and a second sleeve side projection 670 are respectively provided to portions of the sleeve portion 66 opposed to the first throttle portion 710 and the second throttle portion 711 in the radial direction. The sleeve side projections 669, 670 are annular projections projected radially inward from the inner periphery of the sleeve portion 66 beyond the inner periphery of the sleeve portion 66. The first throttle portion 710 and the second throttle portion 711 respectively from the passage with the sleeve side projections 669, 670. When the first throttle portion 710 and the second throttle portion 711 are located respectively away from the sleeve side projections 669, 670 in the axial direction, flow resistance in the passage is small. As the first throttle portion 710 and the second throttle portion 711 respectively overlap the sleeve side projections 669, 670 in the axial direction to increase a surface area opposed to the sleeve side projections 669, 670, flow resistance in the passage becomes large.

An annular pin drain open-close portion 712 is provided between the first lock land 702 and the second lock land 703. The pin drain open-close portion 712 is projected in the radial direction from the outermost periphery of the spool 70. The pin drain open-close portion 712 is provided in the spool 70 and located in a prescribed position relative to the inner periphery of the sleeve portion 66. According to the movable portion of the spool 70, the pin drain open-close portion 712 is positioned in a sliding region, in which the pin drain open-close portion 712 slides relative to the inner periphery of the sleeve portion 66, or positioned in a passage formation region, in which the pin drain open-close portion 712 forms a passage with the inner periphery of the sleeve portion 66. As shown in FIGS. 9 to 11, the pin drain open-close portion 712 blocks the lock port 663 from the second drain port 704*b* when being in the sliding region. Alternatively, as in FIGS. 6, 8, the pin drain open-close portion 712 permits communication between the lock port 663 and the second drain port 704*b* when being in the passage formation region.

Figure 5:
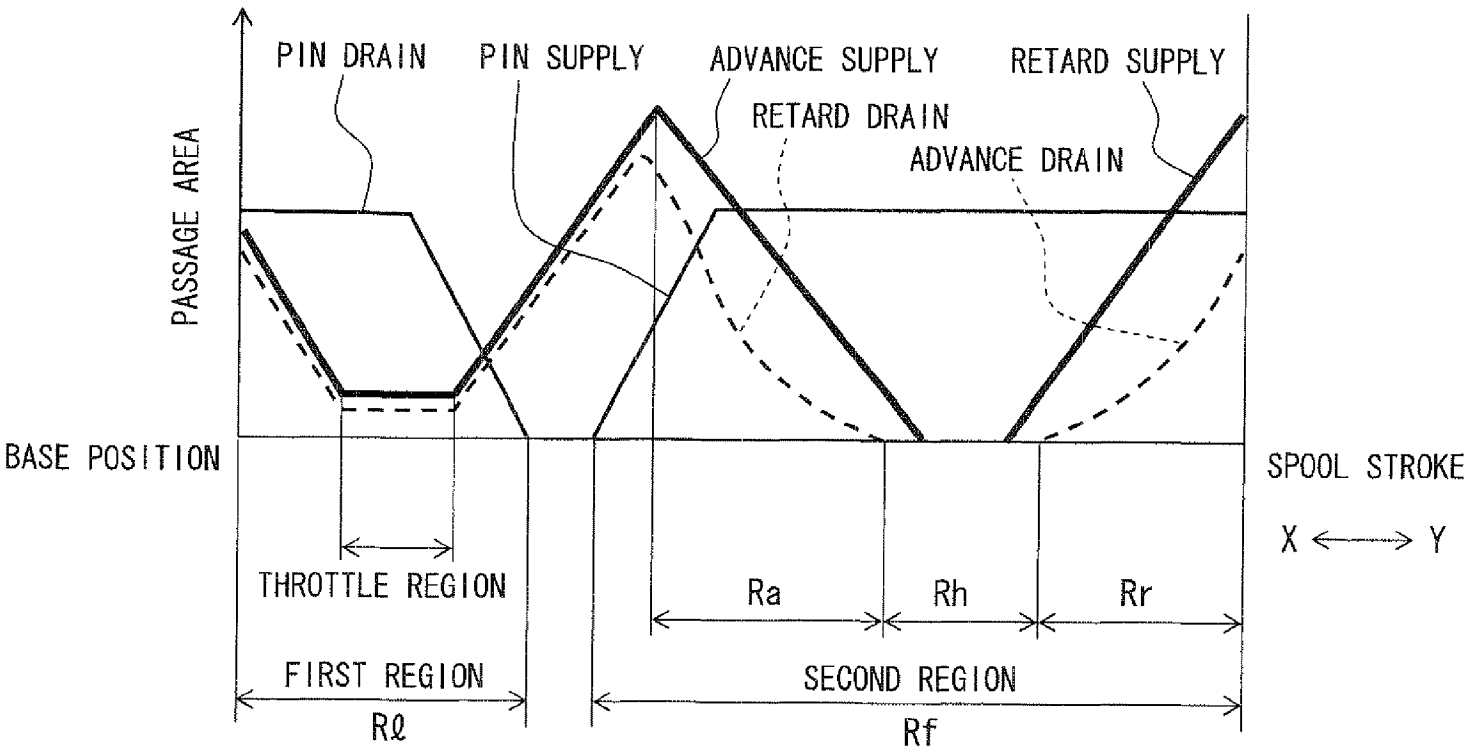
FIG. 5 is a graph showing a relationship between regions of a spool and a passage sectional area between ports in a control portion shown in an FIG. 1.

In the present structure, as shown in FIG. 5, a first region RI (lock region RI) is a stroke range including a spool base position and a throttle region. The spool base position is an end of a movable range of the spool 70 in the first direction X. In the throttle region, an advance supply flow and a retard drain flow are throttled. The advance supply flow is a flow of a working fluid supplied to the advance chambers 22, 23, 24. The retard drain flow is a flow of a working fluid drained from the retard chambers 26, 27, 28.

As shown in FIG. 7C, the first main regulating member 32 of the phase lock portion 30 is fitted to the locking recess portion 152 in the lock region RI, thereby the rotation phase of the vane rotor 14 relative to the housing 11 is maintained. As shown in FIGS. 6 and 8, the spool 70 is in the lock region RI to communicate the advance port 661 with the main supply port 664 across the advance land 700 and the retard land 701. The spool 70 in the lock region RI further communicates the retard port 662, which is communicated with the lock port 663 through the annular groove 668, with the discharge opening 666, 667 through the communication passage 704 across the retard land 701 and the second lock land 703. The spool 70 in the lock region RI blocks the sub-supply port 665 from other ports.

Further, as shown in FIG. 6, when the spool 70 is in the throttle region, a passage area, which is a dominant factor of a circulation flow of a working fluid between the ports 661, 664, is controlled to be smaller than the passage area of the corresponding passage when the spool 70 is in the spool base position as shown in FIG. 8. That is, the opening area of the throttle passage defined by the first throttle portion 710 in FIG. 6 when the spool 70 is in the throttle region is controlled to be smaller than the opening area of the throttle passage defined by the first throttle portion 710 in FIG. 8 when the spool 70 is in the spool base position. Therefore, the advance supply flow and the retard drain flow in the throttle region are smaller than those in the spool base position to enable a phase advance at a slow rotation speed. Thus, the rotation phase change can be gradually performed.

As the spool position moves from the spool base position in the first region RI toward the throttle region in the second direction Y, the distance between the first throttle portion 710 and the inner circumferential periphery (first sleeve side projection 669) of the sleeve portion 66 become small. Thus, the passage area between the ports decreases, and the advance supply flow decreases. In addition, the distance between the second throttle portion 711 and the inner circumferential periphery of the sleeve portion 66 (second sleeve side projection 670) become small. Thus, the passage area between the ports decreases, and the retard drain flow decreases. Furthermore, the pin drain open-close portion 712 maintains the passage area between the lock port 663 and the second drain port 704*b* when the spool 70 moves from the spool base position to the throttle region in the first region RI. Therefore, a pin drain flow, which is a flow of a working fluid exhausted from the lock chamber 31, is substantially constant. Further, when the spool 70 moves in the second direction Y from an intermediate point in the throttle region to the end of the first region RI, the pin drain open-close portion 712 moves to block the passage. Therefore, the passage area between the ports is continually reduced, and the pin drain flow is also continually decreased. Finally, the pin drain open-close portion 712 blocks the passage when being in the end in the second direction Y, and the pin drain flow becomes zero.

On the other hand, as the spool position moves from the end of the throttle region in the second direction Y toward the second region Rf in the second direction Y, the distance between the first throttle portion 710 and the inner circumferential periphery (first sleeve side projection 669) of the sleeve portion 66 become large. Thus, the passage area between the ports increases, and the advance supply flow increases. In addition, the distance between the second throttle portion 711 and the inner circumferential periphery of the sleeve portion 66 (second sleeve side projection 670) become large. Thus, the passage area between the ports increases, and the retard drain flow increases.

As shown in FIG. 5, the second region Rf, which is shifted from the lock region RI in the second direction Y, includes the advance region Ra, the holding region Rh, and the retard region Rr. As shown in FIGS. 9 to 11, in the phase lock portion 30, the first main regulating member 32 in the second region Rf moves away from the locking recess portion 152 and the first regulating recess portion 151. Thereby, the lock of the rotation phase of the vane rotor 14 relative to the housing 11 is released. In addition, the control valve 60 performs the position control of the spool 70 to set the rotation phase to the advance region Ra, the holding region Rh, or the retard region Rr. In the advance region Ra, the rotation phase changes to the advance side. In the holding region Rh, the rotation phase is maintained. In the retard region Rr, the rotation phase changes to the retard side.

As shown in FIG. 9, similarly to the lock region RI, the spool 70 moves to the advance region Ra to communicate the advance port 661 with the main supply port 664 across the advance land 700 and the retard land 701. As shown in FIG. 9, a passage area, which is defined by the first throttle portion 710 and a dominant factor of a circulation flow of a working fluid between the ports 661, 664, is controlled to be larger than the passage area of the corresponding passage when the spool 70 is in the lock region RI as shown in FIG. 6. Accordingly, as shown in FIG. 5, the advance supply flow in the advance region Ra is greater than the advance supply flow in the throttle region.

As shown in FIG. 9, when the spool 70 is in the advance region Ra, in the area between the retard land 701 and the first lock land 702, the retard port 662 communicates with the communication passage 704 through the second drain port 704*b*, and the retard port 662 communicates with the discharge opening 666, 667 through the passage 704. The spool 70 in the advance region Ra communicates the lock port 663 with the sub-supply port 665 in the area between the first and the second lock lands 702, 703. In addition, the spool 70 blocks the lock port 663 from the second drain port 704*b* by the pin drain open-close portion 712, which is slidable on the inner periphery of the sleeve portion 66. Therefore, the lock port 663 is enabled to communicate with the main supply port 664 through the sub-supply passage 52, which communicates with the port 665.

In the advance region Ra, as the spool position moves in the second direction Y, the distance between the advance land 700 and the inner periphery of the first sleeve side projection 669 of the sleeve portion 66 become small. Therefore, the passage area between the ports decreases, and the advance supply flow decreases. In addition, the distance between the retard land 701 and the inner circumferential periphery of the second sleeve side projection 670 of the sleeve portion 66 also becomes small, and the passage area between the ports decreases. Thus, the retard drain flow decreases. Further, in the second region Rf, as the spool position moves in the second direction Y, the passage area between the ports increases by movement of the second lock land 703 to an intermediate position of the advance region Ra. Subsequently, the passage area between the ports becomes substantially constant to the end of the second region Rf in the second direction Y. Therefore, the pin supply flow, which is a flow of a working fluid supplied to the lock chamber 31, becomes constant after the increase.

As shown in FIG. 5, the spool 70 moves to the holding region Rh, which is shifted from the advance region Ra in the second direction Y. In the present condition, as shown in FIG. 10, the spool 70 blocks the advance port 661 from other ports. The spool 70 in the holding region Rh blocks the retard port 662 from other ports.

Further, as shown in FIG. 11, when the spool 70 moves to the retard region Rr, the advance port 661 communicates with the exhaust passage 53 through the first drain port 704*a* on the opposite side of the retard land 701 through the advance land 700. When the spool 70 is in the retard region Rr, the retard port 662 is communicated with the main supply port 664 in the area between the advance land 700 and the retard land 701. Similarly to the case of the advance region Ra, the spool 70 in the retard region Rr communicates the lock port 663 with the sub-supply port 665 in the area between the first and the second lock lands 702, 703. In addition, the spool 70 blocks the lock port 663 from the second drain port 704*b* by the pin drain open-close portion 712, which is slidable on the inner periphery of the sleeve portion 66. Therefore, the lock port 663 is enabled to communicate with the main supply port 664 through the sub-supply passage 52, which communicates with the port 665.

Referring to FIG. 1, the control portion 40 for driving the control valve 60 is provided with a spring 80, a driving source 90, and a control circuit 92. The spring 80 includes a metallic compression coil spring coaxially interposed between the bottom wall of the sleeve portion 66 and the second lock land 703 of the spool 70. The spring 80 is a biasing unit configured to generate resilience accompanied with elastic compression caused between the sleeve portion 66 the spool 70 so as to bias the spool 70 in the first direction X.

As shown in FIG. 1, the driving source 90 is an electromagnetic solenoid including a metallic driving shaft 91. For example, the driving source 90 is mounted to a chain cover fixed to an engine head of the internal combustion engine. The driving shaft 91 is formed in a rod shape and coaxially arranged on the opposite side of the stationary portion 62 of the spool 70. The driving shaft 91 is linearly movable in the axial direction including both the first and second directions X, Y. Irrespective of the movable position of the spool 70, the driving shaft 91 is in contact with the end of the spool 70 on the opposite of the stationary portion 62 by being applied with the biasing force in the first direction X. The driving source 90 generates a driving force when energized to magnetize a solenoid coil (not shown) and cause a magnetic force. The driving source 90 applies the driving force to the driving shaft 91 so as to drive the spool 70 via the driving shaft 91 in the second direction Y. In the present condition, the spool 70 moves to a position in which the driving force caused by the driving source 90 in the second direction Y is balanced with the biasing force in the first direction X. In the present structure, the spool 70 can be arbitrary moved by controlling the driving force caused by the driving source 90 and applied to the spool 70 in the second direction Y via the driving shaft 91. Thus, the spool 70 can be arbitrary controlled at a position in the first region RI or the second region Rf in the state where the driving force is balanced with the biasing force caused by the spring 80 in the first direction X.

The control circuit 92 is an electronic control device including, for example, a microcomputers and the like. The control circuit 92 is electrically connected with the solenoid coil of the driving source 90. The control circuit 92 controls energization of the solenoid of the driving source 90 to control a driving power of the control valve 60. In addition, the control circuit 92 controls a driving operation of the internal combustion engine.

(Operation of Device)

As follows, an operation of the valve timing control apparatus 1 will be described in detail.

(I-1) Lock Operation, Throttle Region Operation (First Region RI)

When an internal combustion engine is in a starting operation or an idling operation, or when an internal combustion engine is stopped, pressure of a working fluid is low. In such a condition, the control circuit 92 energizes the driving source 90 to control the control valve 60 thereby to move the spool 70 to the lock region RI (first region RI). In the present condition, when the operation state is changed from a normal operation state, where lock of the first main regulating member 32 of the phase lock portion 30 is released, to a lock state, the control circuit 92 drives the through spool 70 via the driving shaft 91 to once change the rotation phase from the lock phase to the retard side. The control circuit 92 further provides an instruction corresponding to the throttle region (FIG. 6) in the first region RI.

Consequently, the advance port 661, which communicates with each of the advance chambers 22, 23, 24 through the passages 41, 42, 43, 44, and the main supply port 664, which communicates with the pump 4 through the passages 50, 3 are communicated with each other. Thus, a working fluid is supplied from the pump 4 to each of the advance chambers 22, 23, 24. In addition, the retard port 662, which communicates with each of the retard chambers 26, 27, 28 through the passages 45, 46, 47, 48, and the discharge openings 666, 667, which communicate with the exhaust passage 53, are communicated with each other through the communication passage 704. Thus, a working fluid is discharged from each of the retard chambers 26, 27, 28. The advance supply flow and the retard drain flow in the throttle region are controlled to be significantly smaller than those in other regions of the first region RI other than the throttle region. In the present condition, the rotation speed of the vane rotor 14 toward the advance side accompanied with the flow controlled to be small is significantly gradual and slow, compared with the rotation speed in other regions of the first region RI other than the throttle region.

Further, the lock port 663, which communicates with the lock chamber 31 through the lock passage 200, is further communicated with the discharge openings 666, 667 through the communication passage 704. Thus, a working fluid is discharged from the lock chamber 31. The vane 141 gradually advances in the order shown by FIGS. 7A, 7B, 7C according to the slow rotation of the vane rotor 14. In addition, the first main regulating member 32 moves in the thrust direction X accompanied with the outflow of a working fluid from the lock chamber 31. In the gradual advance movement of the valve timing control apparatus 1 caused by the control valve 60, when the first main regulating member 32 is in the rotation phase corresponding to the locking recess portion 152, the first main regulating member 32 is fitted into the locking recess portion 152 by being applied with resilience of the first main resilient member 33. Thus, the rotation phase lock is completed.

In this manner, the first main regulating member 32 of the phase lock portion 30 locks the rotation phase correspondingly to the position of the spool 70 in the throttle region in the first region RI. Further, the valve timing control apparatus 1 is supplied with a throttled flow. Thereby, the advance angle operation can be performed with a slow rotation speed. Thus, the rotation phase can be steadily locked.

Further, the resilience of the coil spring 100 is effective between the most retard phase and the lock phase. In addition, the coil spring 100 applies a larger torque than an average torque of the camshaft 2 to the vane rotor 14. Therefore, the vane rotor 14 can be advanced by the coil spring 100 to the lock phase. When the first main regulating member 32 is advanced to a rotation phase corresponding to the locking recess portion 152, the first main regulating member 32 is fitted into the locking recess portion 152 by being applied with the resilience of the first main resilient member 33. Thus, the rotation phase lock is completed.

Further, when the spool 70 is in the throttle region, the first sub-regulating member 34 moves relative to the phase lock portion 30 in an exhaust direction (thrust direction X) by being applied with the resilience of the first sub-resilient member 35 to discharge a working fluid. Thereby, the first main regulating member 32 locks the rotation phase by being applied with the resilience. In addition, the advance communication passage 201 is communicated with the retard communication passage 202 through the communication chamber 313. In this manner, the advance chambers 22, 23, 24 communicate with the retard chambers 26, 27, 28. Further, the advance chambers 22, 23, 24 and the retard chambers 26, 27, 28 communicate with the air hole 203, which regularly opens. Presently, pressure difference between the advance chambers 22, 23, 24 and the retard chambers 26, 27, 28 is eliminated by the communication. Thus, hydraulic pressure rotation torque applied to the vane rotor 14 is eliminated.

Further, the lock hole including the locking recess portion 152 and the first regulating recess portion 151 has multiple steps, which stepwise permit the projection operation of the first main regulating member 32 according to the slow rotation. Such a projection operation restricts the first main regulating member 32 from advancing beyond the fitting position corresponding to the locking recess portion 152.

Supposedly, when the first main regulating member 32 is advanced past the locking recess portion 152 without being fitted into the locking recess portion 152, the hydraulic advance torque caused by the vane 141, 142 disappears, and the advance torque caused by the coil spring 100 also disappears on the advance side relative to the lock phase. In the present condition, the vane rotor 14 is retarded by being applied with the average torque of the camshaft 2 shown in FIG. 4. In addition, the vane rotor 14 is moved from a lock phase toward the retard side by being applied with positive component of the cam torque fluctuation. Therefore, in the mechanism of the valve timing control apparatus 1 according to the present embodiment, the locking operation of the rotation phase can be automatically performed again by the first main regulating member 32. Thus, the rotation phase lock control can be further steadily performed.

(I-2) Starting of Internal Combustion Engine (First Region RI)

Before starting of the internal combustion engine, a working fluid has not been supplied yet. In such a condition, air is contained in a main body of the valve timing control apparatus 1, a supply passage of the pump 4 as a supply source, and the like. When the internal combustion engine is being started, as shown in FIGS. 5, 8, the spool 70 of the control valve 60 is in the spool base position. In the present condition, the advance port 661 is communicated with the main supply port 664, and a working fluid is supplied from the pump 4 into each of the advance chambers 22, 23, 24. Further, in the phase lock portion 30, the first sub-regulating member 34 discharges a working fluid from the lock chamber 31 by being applied with the resilience of the first sub-resilient member 35, and the first main regulating member 32 locks the rotation phase by being applied with the resilience. In addition, the advance communication passage 201 and the retard communication passage 202 communicate with the communication chamber 313.

Subsequently, the internal combustion engine starts an operation, and the pump 4 starts supply of a working fluid. In the present condition, a working fluid flows into the main supply port 664 through the main supply passage 50. The working fluid further passes around the outer periphery of the spool 70. Thus, the working fluid is supplied from the advance port 661 into the advance chambers 22, 23, 24. The working fluid supplied to the advance chamber 22 flows through the advance communication passage 201, the communication chamber 313, the retard communication passage 202, the retard chamber 26, the retard port 662, the second drain port 704*b*, the communication passage 704, the exhaust passage 53, and the oil sump 6 in this order. In this manner, a working fluid supplied by the pump 4 promptly circulates. Thereby, air contained in the circulation path is replaced with a working fluid and discharged.

As described above, in the starting of the internal combustion engine, a working fluid circulation operation is performed to circulate a working fluid promptly through the valve timing control apparatus 1. Thereby, a waiting time for starting the valve timing control apparatus 1 can be shortened. In addition, a phase operation needed from the internal combustion engine needs can be promptly performed. Furthermore, in the starting of the internal combustion engine, the internal combustion engine may be stopping in a state where that the first main regulating member 32 is not fitted into the locking recess portion 152. Even in such a condition, the first sub-regulating member 34 is in a position to communicate the advance communication passage 201 with the retard communication passage 202 by being applied with the resiliency of the first sub-resilient member 35, irrespective of the state of the first main regulating member 32. Therefore, the first sub-regulating member 34 can secure a circulation path to circulate a working fluid promptly to the circulation path.

Further, after starting of the circulation operation of a working fluid, the control circuit 92 controls the spool 70 to move to the throttle region (I-1) Accompanied with the movement of the spool 70, the distance between the first throttle portion 710 and the first sleeve side projection 669 becomes small. Thereby, the passage area between the ports decreases, and the circulation flow of a working fluid is regulated. In this manner, the circulation flow of a working fluid is regulated to be less than the circulation flow in the beginning of starting of the internal combustion engine. Thereby, a working fluid circulation operation can be maintained with a small amount of the circulation flow for securing prompt starting of the valve timing control apparatus 1. Thus, an operation load of the pump 4 can be reduced.

(II) Advance Angle Operation (Advance Region Ra)

For example, an internal combustion engine requires a relatively large engine torque when being operated in a low or middle speed and applied with a high load. In such a condition, the control circuit 92 energizes the driving source 90 to perform a driving power control of the control valve 60. Thereby, the control circuit 92 controls the spool 70 to move to the advance region Ra shown in FIG. 9. Consequently, accompanied with the lock operation (I-1), the advance port 661 is communicated with the main supply port 664, and a working fluid is supplied from the pump 4 into each of the advance chambers 22, 23, 24. In addition, the retard port 662 is communicated with the second drain port 704*b*, and a working fluid is discharged from each of the retard chambers 26, 27, 28 to the exhaust passage 53. Further, the lock port 663, which is communicated with the lock chamber 31 through the lock passage 200, and the sub-supply port 665, which is communicated with the pump 4 through the sub-supply passage 52, are communicated with other. Thus, a working fluid is supplied into the lock chamber 31.

Accompanied with supply of a working fluid into the lock chamber 31, the first sub-regulating member 34 is moved in the retract direction Y against resiliency of the first sub-resilient member 35. Thereby, the bottom surface of the large-diameter supporting portion 312 urges the fitted portion 341 in the retract direction Y. Thus, the first main regulating member 32 is retracted from the locking recess portion 152 and the first regulating recess portion 151, and the lock is released. In this manner, the advance chambers 22, 23, 24 are blocked from the retard chambers 26, 27, 28. Further, the advance chambers 22, 23, 24 and the retard chambers 26, 27, 28 are blocked from the air hole 203, which regularly opens.

As described above, when the spool 70 is in the advance region Ra, a working fluid is supplied into each of the advance chambers 22, 23, 24 and discharged from each of the retard chambers 26, 27, 28 in the state where the lock of the first main regulating member 32 is released by supplying a working fluid into the lock chamber 31. For example, the spool 70 is moved to a marginal position of the advance region Ra on the side of the lock region RI in FIG. 5. Thereby, a circulation flow of a working fluid becomes the maximum between the ports 661, 664 through the maximum passage area in the advance region Ra. Therefore, the valve timing can be quickly advanced.

When the spool 70 is controlled in the second region Rf, the first main regulating member 32 needs to be maintained in the lock released state. More specifically, in the advance region Ra, in which the rotation phase is changed to the advance side, in the retard region Rr, in which the rotation phase is changed to the retard side, or in the holding region Rh, in which the rotation phase is maintained between the advance region Ra and the retard region Rr, the first main regulating member 32 needs to be maintained in the lock released state.

However, for example, an advance angle operation of the valve timing control apparatus 1 in the advance region Ra may be performed when the internal combustion engine is in an operation state. In such a condition, when the vane 141 is applied with a torque fluctuation component of the camshaft 2 to receive a negative torque, the vane 141 moves in the advance direction to increase the volume of the advance chamber 22. Consequently, a pressure in the advance chamber 22 decreases. Consequently, a working fluid flows from the pump 4 into the advance chamber 22, which is lowered in pressure. In addition, a working fluid is forced to flow from the sub-supply port 665 through the sub-supply passage 52 into the branch portion 51. Accompanied with the movement of a working fluid, the first sub-regulating member 34 of the phase lock portion 30 is moved in the thrust direction X. Consequently, the lock released state of the first main regulating member 32 may not be maintained. In the present condition, when the rotation phase of the vane 141 changes, the first main regulating member 32 may be projected into the locking recess portion 152 or the first regulating recess portion 151. Consequently, the first main regulating member 32 may be stuck in the locking recess portion 152 or the first regulating recess portion 151 to disturb smooth change in the rotation phase of the vane 141.

For example, in the apparatus disclosed in the US PATENT 2002/0139332 A1, it is conceived to arrange a spool valve for a phase control near a lock unit for a phase lock. In particular, when the spool valve for a phase control is accommodated in a main body such as a vane rotor of the valve timing control apparatus 1, the spool valve is located near the lock unit. Accordingly, pulsation of a working fluid is easily transmitted to the lock chamber through the lock passage, which communicates the lock chamber with the spool valve. In such a case, pulsation of a working fluid may exert an adverse effect on an operation of the lock unit to disturb a suitable control operation of the valve timing control apparatus.

In view of such a problem, in the valve timing control apparatus 1 according to the present embodiment, the sub-check valve 520 is provided in the sub-supply passage 52, which branches from the main supply passage 50 at the branch portion 51 in the downstream of the working fluid supply source. The sub-check valve 520 includes a valve element in a lead shape. The sub-check valve 520 restricts a working fluid from flowing from the sub-supply port 665 to the branch portion 51. Thereby, the backflow restriction function of the sub-check valve 520 can maintain the lock released state of the first main regulating member 32. Therefore, the valve timing can be quickly controlled in the second region Rf.

Alternatively, for example, an advance angle operation of the valve timing control apparatus 1 may be performed when the internal combustion engine is in an operation state. In such a condition, when the vane 141 is applied with a torque fluctuation component of the camshaft 2 to receive a positive torque, the vane 141 moves in the retard direction to decrease the volume of the advance chamber 22. Consequently, a pressure in the advance chamber 22 increases. A working fluid is forced to flow from the advance chamber 22, which is increased in pressure, to the pump 4. However, such a flow of a working fluid is restricted by the main check valve 500 provided between the main supply port 664 and the pump 4 in the main supply passage 50. Furthermore, the operation of the main check valve 500 to restrict a working fluid from a backflow causes a hydraulic pressure transmitted through the branch portion 51, the sub-supply passage 52, and the lock passage 200 to move the first sub-regulating member 34 in the lock chamber 31 in the retract direction Y. However, the hydraulic pressure caused by the operation of the main check valve 500 works to maintain the released state of the first main regulating member 32. Therefore, such an operation of the main check valve 500 does not exert an adverse effect on the operation of the valve timing control apparatus 1.

(III) Holding Operation (Holding Region Rh)

For example, an internal combustion engine is in a normal operation when an acceleration pedal of the vehicle is maintained in a constant position. In such a condition, the control circuit 92 energizes the driving source 90 to perform a driving power control of the control valve 60. Thereby, the control circuit 92 controls the spool 70 to move to the holding region Rh shown in FIG. 10.

Consequently, the advance port 661, which is communicated with each of the advance chambers 22, 23, 24 through the passages 41, 42, 43, 44, is blocked from the others ports. Therefore, supply of a working fluid into each of the advance chambers 22, 23, 24 is stopped, and a working fluid is accumulated in each of the advance chambers 22, 23, 24. In addition, the retard port 662, which is communicated with each of the retard chambers 26, 27, 28 through the passages 45, 46, 47, 48, is blocked from the others ports. Therefore, supply of a working fluid into each of the retard chambers 26, 27, 28 is stopped, and a working fluid is accumulated in each of the retard chambers 26, 27, 28. Furthermore, accompanied with the advance angle operation (II), the lock port 663, the main supply port 664, and the sub-supply port 665 are communicated with each other. Thus, a working fluid is supplied into the lock chamber 31.

As described above, when the spool 70 is in the holding region Rh, a working fluid is supplied into each of the advance chambers 22, 23, 24 and each of the retard chambers 26, 27, 28 in the state where the lock of the first main regulating member 32 is released by supplying a working fluid into the lock chamber 31, similarly to the advance angle operation (II). In this manner, the valve timing can be maintained.

(IV) Retard Angle Operation (Retard Region Rr)

For example, an internal combustion engine requires a relatively small engine torque when being applied with a low load. In such a condition, the control circuit 92 energizes the driving source 90 to perform a driving power control of the control valve 60. Thereby, the control circuit 92 controls the spool 70 to move to the retard region Rr shown in FIG. 11.

Consequently, the advance port 661, which communicates with each of the advance chambers 22, 23, 24 through the passages 41, 42, 43, 44, and the discharge openings 666, which communicates with the exhaust passage 53, are communicated with each other through the first drain port 704*a* and the communication passage 704. Thus, a working fluid is discharged from each of the advance chambers 22, 23, 24. In addition, the retard port 662, which communicates with each of the retard chambers 26, 27, 28 through the passages 45, 46, 47, 48, and the main supply port 664, which communicates with the pump 4, are communicated with each other through the passages 45, 46, 47, 48. Thus, a working fluid is supplied from the pump 4 into each of the retard chambers 26, 27, 28. Furthermore, accompanied with the advance angle operation (II), the lock port 663 and the sub-supply port 665 are communicated with each other. Thus, a working fluid is supplied into the lock chamber 31.

As described above, when the spool 70 is in the retard region Rr, a working fluid is supplied into the lock chamber 31 to release the lock of the first main regulating member 32. Thus, a working fluid is supplied into each of the retard chambers 26, 27, 28, and a working fluid is discharged from each of the advance chambers 22, 23, 24, in the state where the lock of the first main regulating member 32 is released similarly to the advance angle operation (II) and the holding operation (III). For example, the spool 70 is moved to a marginal position of the retard region Rr, which is an end (movable end) of a movable range in the second direction Y in FIG. 5. Thereby, a circulation flow of a working fluid becomes the maximum between the ports 662, 664 through the maximum passage area in the retard region Rr. Therefore, the valve timing can be quickly retarded.

When an internal combustion engine is stopped, the first main regulating member 32 is normally fitted into the locking recess portion 152 and held in the locking recess portion 152 to prepare for a next starting. However, when a malfunction occurs, the first main regulating member 32 may be held in a state where the locking recess portion 152 is not locked by the first main regulating member 32. In such a case, in particular, when the internal combustion engine stops when the vane rotor 14 is in the maximum retard position, a close phase of the intake valve is retarded, and a compression ratio decreases. Consequently, as the temperature decreases, a starting performance of the internal combustion engine may be impaired. Accordingly, it is desired to return the rotation phase to the starting phase as quickly as possible when the internal combustion engine is started. A cam torque fluctuates in a cranking operation when the internal combustion engine is started. In the present embodiment, the rotation phase can be returned by itself to the starting phase by utilizing the negative torque in the cranking operation.

Specifically, when the spool 70 of the control valve 60 is in the base position and when the first main regulating member 32 is not fitted in the locking recess portion 152 and the first regulating recess portion 151 as shown in FIG. 7A, the vane rotor 14 is fluctuated in the advance direction by being applied with a negative torque component of the cam torque fluctuation in a clanking operation when the internal combustion engine is started. When a temperature of a working fluid is low, viscosity of a working fluid is high. In such a condition, even when the vane rotor 14 is fluctuated in the advance direction to increase the volume of the advance chamber 22, supply of a working fluid from the pump 4 may become insufficient. Consequently, an internal pressure of the advance chamber 22 may be below an atmospheric pressure. In such a case, fluctuation of the vane rotor 14 toward the advance side in a period when being applied with a negative torque may become small. Thus, the vane rotor 14 may be again returned to the maximum retard angle in a period when being applied with a positive torque in a cam torque fluctuation cycle.

In the present embodiment, even when the first main regulating member 32 is not fitted, the first sub-regulating member 34 discharges a working fluid from the lock chamber 31 by being applied with the resilience. In addition, the first sub-regulating member 34 operates to communicate the advance chamber 22 and the retard chamber 26 with the air hole 203. In this case, when the internal pressure of the advance chamber 22 becomes to be less than the atmospheric pressure due to a negative torque in the clanking operation, atmosphere can be fed from the air hole 203 into the advance chamber 22 through the advance communication passage 201 and the retard communication passage 202. Therefore, fluctuation of the vane rotor 14 in the advance side becomes large in the period in which a negative torque is applied.

The first regulating recess portion 151 is provided to the phase lock portion 30 on the side of the front plate 15 to extend in the advance direction toward the lock phase. The locking recess portion 152 is provided to the phase lock portion 30 on the side of the front plate 15. The locking recess portion 152 is a deep bottom portion formed on the advance side relative to the first regulating recess portion 151. As shown in FIG. 7B, the first main regulating member 32 is first projected into the first regulating recess portion 151, which is a narrow bottom portion, when the vane rotor 14 is fluctuated toward the advance side. Thereby, even when a positive torque of a cam torque fluctuation is applied, the first main regulating member 32 is capable of restricting the vane rotor 14 from being returned to the maximum retard side. Further, in the subsequent period, in which a negative torque is applied, the vane rotor 14 is further fluctuated toward the advance side from a base phase shown in FIG. 76. The present operation is repeated, so that the vane rotor 14 is advanced to the lock phase shown in FIG. 7C in the clanking operation suited for engine start.

The valve timing control apparatus according to the present embodiment includes the first sub-regulating member 34 and the first sub-resilient member 35. The first sub-regulating member 34 functions as a lock unit and includes the pressure-receiving portion 340 and the fitted portion 320. The pressure-receiving portion 340 is accommodated in the vane rotor 14 to be movable in the same direction as the movable direction of the first main regulating member 32. The pressure-receiving portion 340 is applied with a pressure in the retract direction from a working fluid supplied into the lock chamber 31. The fitted portion 320 is fitted with the first main regulating member 32 in the retract direction and spaced from the first main regulating member 32 in the thrust direction. The first sub-resilient member 35 biases the first sub-regulating member 34 in the thrust direction.

In the present structure, a working fluid is supplied from the pump 4 with an operation of the internal combustion engine, and the supplied working fluid is fed into the lock chamber 31. The internal combustion engine may cause a lock to stop before the first main regulating member 32 thrusts into the locking recess portion 152 to regulate the rotation phase within the regulation phase between the maximum advanced phase and the maximum retarded phase. In such a condition, pressure of a working fluid fed into the lock chamber 31 decreases. Consequently, the first sub-regulating member 34 located in the pressure-receiving portion 340 is applied with pressure in the retract direction from a working fluid in the lock chamber 31. Thus, the first sub-regulating member 34 moves in the thrust direction by being biased from the first sub-resilient member 35. In the present condition, the first main regulating member 32, to which the first sub-regulating member 34 is fitted via the fitted portion 320 in the retract direction, is biased from the first main resilient member 33 to move with the first sub-regulating member 34. Therefore, the first main regulating member 32 makes contact with the inner surface of the housing 11 in a rotation phase different from the regulation phase in particular. Thus, the first main regulating member 32 makes contact with the inner surface of the housing 11 to be immovable relative to the housing 11. Even after such a condition, the first sub-regulating member 34 biased from the first sub-resilient member 35 moves to extrude remaining hydraulic fluid in the lock chamber 31 via the pressure-receiving portion 340. Simultaneously, the first sub-regulating member 34 is movable in the thrust direction relative to the first main regulating member 32 to be spaced from the fitted portion 320. In this manner, in a clanking operation when the internal combustion engine is started, the rotation phase is changed to the regulation phase by applying the fluctuating torque caused by the clanking operation to thrust the first main regulating member 32 into the locking recess portion 152. Thus, the fitted portion 320 of the first main regulating member 32 can be moved in the thrust direction at a high speed, irrespective of a remaining hydraulic fluid in the lock chamber 31. Therefore, the rotation phase can be further steadily locked to enhance a phase locking performance. Even in a low-temperature environment, the rotation phase can be regulated to the regulation phase by quickly and steadily thrusting the first main regulating member 32 into the locking recess portion 152. Therefore, an engine starting performance can be secured.

Further, the first sub-regulating member 34 is configured to be fitted to the outer periphery of the first main regulating member 32. The vane rotor 14 has the small-diameter supporting portion 311 to support the outer periphery of the first main regulating member 32. The first sub-regulating member 34 forms the lock chamber 31 with the pressure-receiving portion 340, which is opposed to the small-diameter supporting portion 311 in the first sub-regulating member 34.

In the present structure, pressure of a working fluid supplied into the lock chamber 31 is hard to be applied to the first main regulating member 32. Therefore, a working fluid remaining in the lock chamber 31 may not disturb the movement of the first main regulating member 32 in the thrust direction X. Therefore, a performance of the rotation phase lock can be secured. In a start operation of the internal combustion engine by performing a cranking operation, even when a working fluid remains in the lock chamber 31, such a remaining working fluid can be restricted from lowering the speed of the first main regulating member 32 moving in the thrust direction X. Therefore, when the rotation phase is changed to the regulation phase to thrust the first main regulating member 32 into the locking recess portion 152, quick movement of the first main regulating member 32 can be steadily secured even under a low-temperature environment. Thus, an engine starting performance can be steadily secured under a low-temperature environment.

The vane 141 has the air hole 203, which is opened in the inner surface of the large-diameter supporting portion 312 to communicate with the outside of the large-diameter supporting portion 312 and configured to receive and discharge external air. The end of the first sub-regulating member 34 in the retract direction Y moves in the thrust direction X beyond a blockade position, at which the end of the first sub-regulating member 34 blocks the advance communication passage 201 and the retard communication passage 202 from the communication chamber 313. Whereby, the air hole 203 is communicated with both the advance communication passage 201 and the retard communication passage 202.

In this way, when the internal combustion engine stops before the rotation phase is locked by the first main regulating member 32 moved in the thrust direction X, the first sub-regulating member 34 moves in the thrust direction X beyond the blockade position to communicate the air hole 203 with the communication passages. Under such a communication state, even when a working fluid remains in one of the advance chamber 22 and the retard chamber 26 in a clanking operation when the internal combustion engine is started, a working fluid remaining in the one chamber can be moved to the other chamber through the advance communication passage 201 and the retard communication passage 202, which are communicated with both the advance chamber 22 and the retard chamber 26. In addition, in the starting operation, even when the viscosity of a working fluid is high and such a working fluid is hard to be moved due to, for example, deterioration, coldness, and/or the like, air can be supplied into the advance chamber 22 and the retard chamber 26 through the air hole 203. Therefore, when the rotation phase is changed to the regulation phase and when the first main regulating member 32 is thrust into the locking recess portion 152, the following conditions can be restrained: decrease in a speed of a rotation phase change due to a working fluid remaining in the advance chamber 22 or the retard chamber 26; and decrease in a speed of a rotation phase change due to negative pressure caused in the advance chamber 22 or the retard chamber 26 due to increase in a volume caused by a fluctuating torque under a clanking operation. Therefore, a starting performance of the valve timing control apparatus 1 can be enhanced so as to quickly change the rotation phase required for thrusting the first main regulating member 32 into the locking recess portion 152.

When the first main regulating member 32 is retracted from the locking recess portion 152, the first sub-regulating member 34 is moved to the blockade position, which is beyond the communication position between the communication passages in the retract direction Y. Whereby, the advance communication passage 201 can be blocked from the retard communication passage 202. Therefore, when the valve timing is controlled by supplying a working fluid to one of the advance chamber 22 and the retard chamber 26 under such a blockade state, leakage of a working fluid from the one to the other through the advance communication passage 201 and the retard communication passage 202 can be restrained. Thus, a response of the valve timing control can be enhanced.

Further, the opening area of the air hole 203 may be greater than the passage areas of the advance communication passage 201 and the retard communication passage 202. In this case, in a communication path formed by the first sub-regulating member 34 moved in the thrust direction X to communicate the air hole 203 with the advance communication passage 201 and the retard communication passage 202, a flow resistance of air becomes smaller than a flow resistance of a working fluid. Therefore, in a clanking operation when the internal combustion engine is started under a state in which the air hole 203 is communicated with the advance communication passage 201 and the retard communication passage 202, a working fluid is restricted from leaking from the advance chamber 22 and the retard chamber 26, which are respectively in communication with the advance communication passage 201 and the retard communication passage 202. Thus, air can be easily supplied into the advance chamber 22 and the retard chamber 26. Therefore, when the rotation phase is changed to the regulation phase and when the first main regulating member 32 is thrust into the locking recess portion 152, the speed change of the rotation phase is enhanced, and a starting performance of the valve timing control apparatus 1 can be enhanced.

Figure 4:
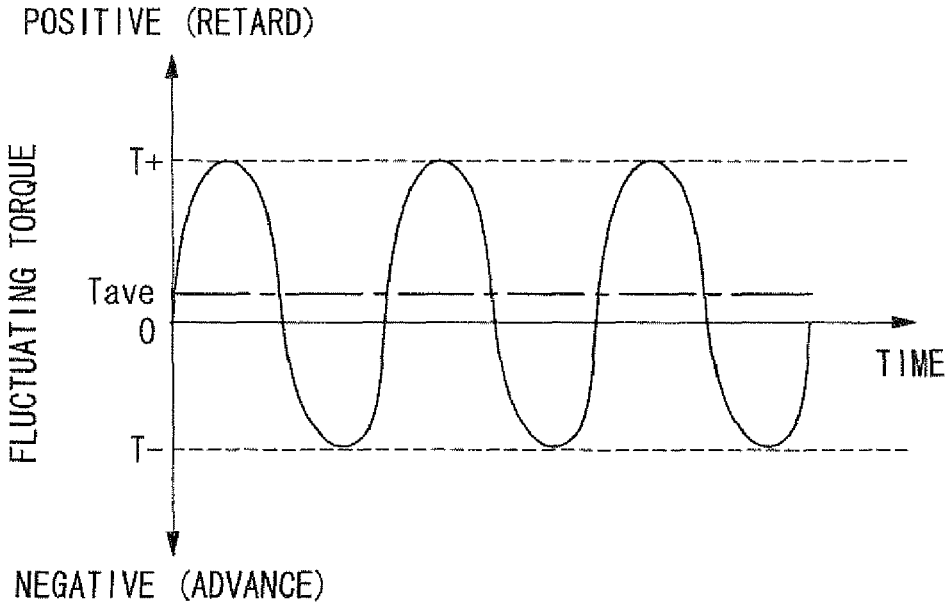
FIG. 4 is a graph showing a fluctuating torque applied to the actuator portion shown in FIG. 1.

According to the valve timing control apparatus 1 of the present embodiment, both an advance supply flow and a retard drain flow are throttled in the throttle region in the first region RI. The rotation phase may be locked in a condition where the cam torque fluctuation shown in FIG. 4 is large. In such a condition, even when a working fluid is discharged from the retard chamber 26 and air flows into the retard chamber 26 due to fluctuation of the vane rotor 14, change in the rotation phase can be restricted by throttling both the advance supply flow and the retard drain flow in the throttle region in a condition where the lock is released in the subsequent condition. In addition, the advance communication passage 201 and the retard communication passage 202 are provided to communicate the advance chamber 22 with the retard chamber 26. In the present structure, the slow phase change of the vane rotor 14 toward the advance side can be further promoted by throttling the retard drain flow in addition to the advance supply flow in the throttle region.

The valve timing control apparatus 1 further includes the coil spring 100 as an assisting spring to apply a biasing force larger than an average fluctuating torque, which is transmitted from the camshaft 2 and eccentrically applied toward the retard side on average. The coil spring 100 biases the vane rotor 14 toward the advance side against the fluctuating torque. In the present structure, when being on the retard side relative to the middle phase, the coil spring 100 enables to change the rotation phase to the middle phase by the biasing force of the coil spring 100 when the internal combustion engine stops. Contrary, when being on the advance side relative to the middle phase, the rotation phase can be changed to the middle phase when the internal combustion engine stops by utilizing a fluctuating torque eccentrically acting toward the retard side on average. In the present structure, the internal combustion engine can be steadily started by controlling the rotation phase from both sides in the engine start operation.

Further, in the valve timing control apparatus 1, the spool 70 has the annular first throttle portion 710 projected in the radial direction from the outer periphery of the spool 70. The advance supply passage is formed between the first throttle portion 710 and sleeve portion 66 to communicate the advance port 661, which is communicated with the advance chamber 22, with the main supply port 664. The cross-sectional area of the advance supply passage is controlled to be smaller when being in the throttle region compared with that when being in the movable end of the spool 70 in the first direction X. In the present structure, the throttle region is defined in the first region RI by providing the annular first throttle portion 710. The first throttle portion 710 may be formed in the spool 70 such that the advance supply flow is obtained as a desired throttle flow by forming the cross-sectional area of the advance supply passage between the first throttle portion 710 and the spool 70. Therefore, the valve timing control apparatus 1 of a high productivity can be provided.

Further, the spool 70 has the annular second throttle portion 711 projected in the radial direction from the outer periphery of the spool 70. The retard drain passage is formed between the second throttle portion 711 and the spool 70 to communicate the retard port 662, which is communicated with the retard chamber 26, with the discharge openings 666, 667. The cross-sectional area of the retard drain passage is controlled to be smaller when being in the throttle region compared with that when the spool 70 is in the movable end in the first direction X.

In the present structure, the throttle region is defined in the first region RI by providing the annular second throttle portion 711. The second throttle portion 711 may be formed in the spool 70 such that the retard drain flow is obtained as a desired throttle flow by forming the cross-sectional area of the retard drain passage between the second throttle portion 711 and the spool 70. Therefore, the valve timing control apparatus 1 of a high productivity being configured to throttle the advance supply flow and the retard drain flow in the throttle region can be provided.

Second Embodiment

Figure 12:
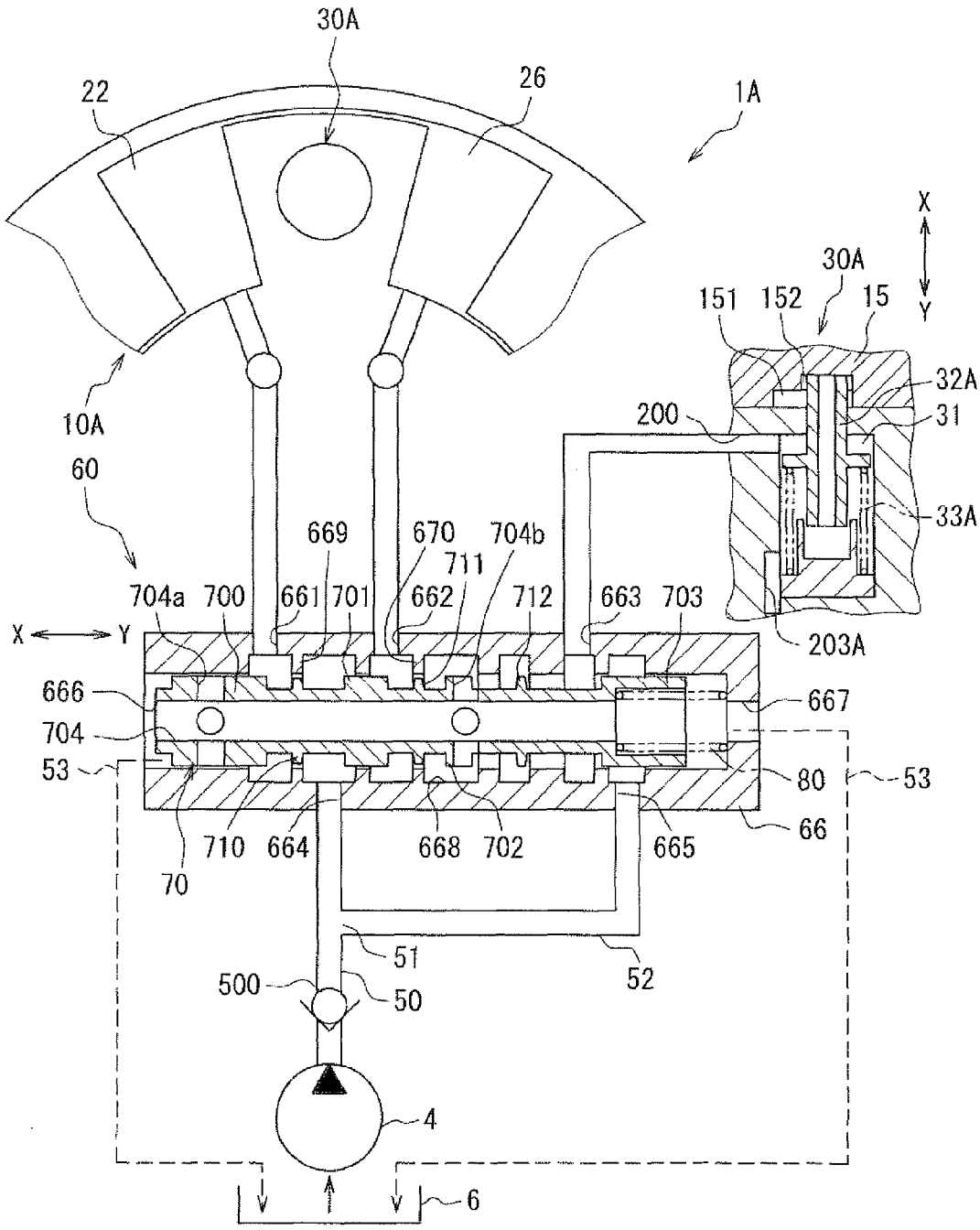
FIG. 12 is a schematic sectional view showing a main component of a control portion of a valve timing control apparatus according a second embodiment.

The second embodiment as a modification of the first embodiment will be described with reference to FIGS. 12 and 13. As shown in FIG. 12, the present second embodiment is different from the first embodiment in the following two structures. First, contrary to the phase lock portion 30 of the first embodiment, a phase lock portion 30A of the second embodiment is a first regulating member 32A, which is a single pin. Second, the advance communication passage 201 and the retard communication passage 202 are not provided.

(First Regulating and Locking Structure)

The first accommodation hole 310 of the second embodiment accommodates a first metallic regulating member 32A and a first resilient member 33A. The first resilient member 33A includes a metallic compression coil spring to generate resilience when being elastic deformed to bias the first regulating member 32A toward the front plate 15. The lock chamber 31 is an annular space formed between the inner surface of the front plate 15 and the outer surface of an annular projection 320A on the side of the front plate 15. The annular projection 320A is formed in a middle portion of the first regulating member 32A in the axial direction. The vane 141 has an air hole 203A, which is opened in the inner surface of the large-diameter supporting portion 312 to communicate with the outside of the large-diameter supporting portion 312 and configured to receive and discharge external air. The air hole 203A communicates an annular space, which is formed between the inner surface of the first accommodation hole 310 and the outer surface of the projection 320A on the opposite side from the front plate 15, and the outside.

The outer periphery of the first regulating member 32A is slidably supported by the small-diameter supporting portion 311. The outer periphery of the projection 320A is slidably supported by the inner surface of the large-diameter supporting portion 312. Thus, the first regulating member 32A is movable back and forth in the axial direction. The first regulating member 32A has an inner circumferential periphery defining the through-hole 321, which regularly communicates the side of the front plate 15 with the opposite side from the front plate 15.

Figure 13A:
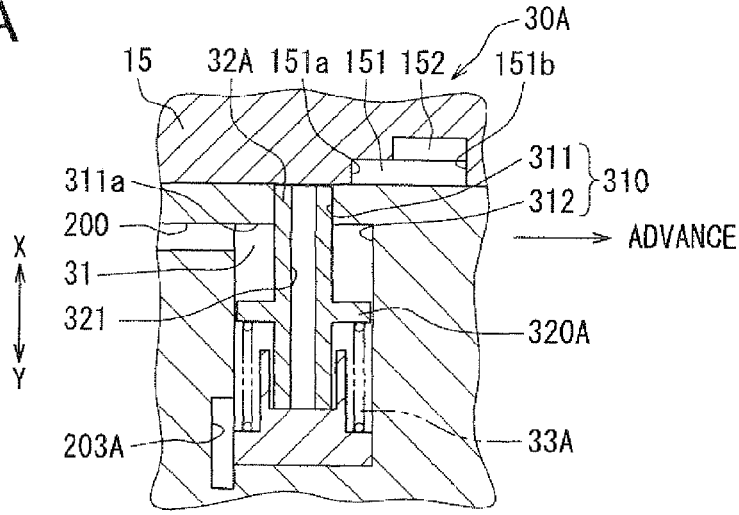
FIGS. 13A to 13C are sectional views each showing a lock unit shown in FIG. 12.
Figure 13B:
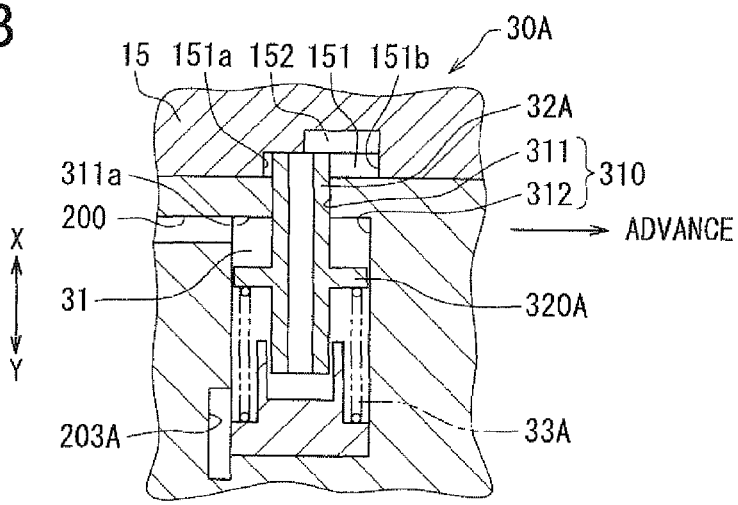

As shown in FIG. 13B, the first regulating member 32A moves in the thrust direction X when being in the regulation phase region including the lock phase, thereby thrusting into the first regulating recess portion 151 of the housing 11. In this manner, as shown in FIG. 13B, the first regulating member 32A, which thrusts into the first regulating recess portion 151, is retained by the regulation stopper 151*a* defined by the end of the first regulating recess portion 151 on the retard side. Thereby, change in the rotation phase toward the retard side is regulated at the first regulation phase, which is a limit of the regulation phase region on the retard side. On the other hand, the first regulating member 32A, which thrusts into the first regulating recess portion 151, is retained by the regulation stopper 151*b* defined by an end of the first regulating recess portion 151 on the advance side. Thereby, change in the rotation phase on the advance side is regulated in the lock phase.

Figure 13C:
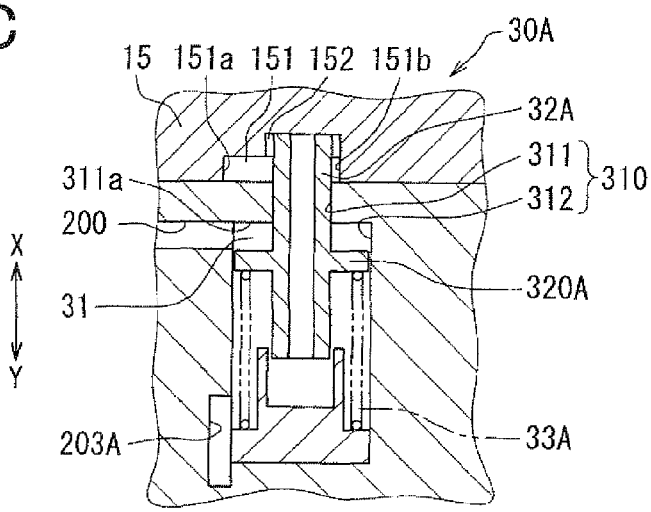

As shown in FIG. 13C, the first regulating member 32A moves in the thrust direction X when being in the lock phase, thereby thrusting into the locking recess portion 152 of the housing 11. The first regulating member 32A thrusting into the locking recess portion 152 in this way is fitted with the locking recess portion 152. Thereby, the first main regulating member 32 regulates change in the rotation phase on both the advance side and the retard side to lock the rotation phase in the lock phase.

Further, the first regulating member 32A moves in the retract direction Y when being in the regulation phase region including the lock phase. Thereby, the first main regulating member 32 is retracted from both the locking recess portion 152 and the first regulating recess portion 151 of the housing 11. In this manner, the first regulating member 32A is retracted from the recess portions 152, 151, thereby to cancel regulation of the rotation phase so as to allow arbitrary change in the rotation phase.

The first regulating member 32A is exposed to the lock chamber 31. The outer surface of the projection 320A of the first regulating member 32A on the side of the front plate 15 is applied with pressure in the retract direction Y from a working fluid in the lock chamber 31. Thereby, a driving force to move the first regulating member 32A in the retract direction Y occurs.

The first resilient member 33A is interposed between the bottom surface defining the first accommodation hole 310 and located on the opposite side from the front plate 15 and the first regulating member 32A. The first resilient member 33A causes first resilience when compressed between the surface of the first accommodation hole 310 and the first regulating member 32A, thereby to bias the first regulating member 32A in the thrust direction X. In the present structure, the first resilience of the first resilient member 33A is applied to thrust the first regulating member 32A in the thrust direction X when being out of the regulation phase range including the most retard phase. Thereby, as shown in FIG. 13A, the first regulating member 32A can be in contact with the inner surface of the front plate 15.

In the present structure, as shown in FIG. 13C, the rotation phase of the vane rotor 14 relative to the housing 11 is maintained in an actuator portion 10A when the first regulating member 32A is locked by being fitted into the locking recess portion 152. On the contrary, as shown in FIG. 13A, when the first regulating member 32A is retracted from the locking recess portion 152 and the first regulating recess portion 151 to release the lock, a working fluid is supplied into the advance chambers 22, 23, 24, and a working fluid is discharged from the retard chambers 26, 27, 28. Thereby, the rotation phase changes toward the advance side, and the valve timing is advanced. When the lock is released, a working fluid is supplied into the retard chambers 26, 27, 28, and a working fluid is discharged from the advance chambers 22, 23, 24. Thereby, the rotation phase changes toward the retard side, and the valve timing is retarded.

The valve timing control apparatus 1A of the second embodiment does not include the advance communication passage 201 and the retard communication passage 202 of the first embodiment. Therefore, the circulation of a working fluid in a starting operation of the internal combustion engine described in the first embodiment is not performed. In addition, in the valve timing control apparatus 1A, the sub-check valve 520 is not provided in the sub-supply passage 52. Therefore, in the present second embodiment, the lock-release condition cannot be maintained when being controlled in the second region Rf by the backflow restriction function. The other structures of the valve timing control apparatus 1A are similar to the corresponding structures of the valve timing control apparatus 1 of the first embodiment and are configured to produce similar operation effects.

Third Embodiment

Figure 14:
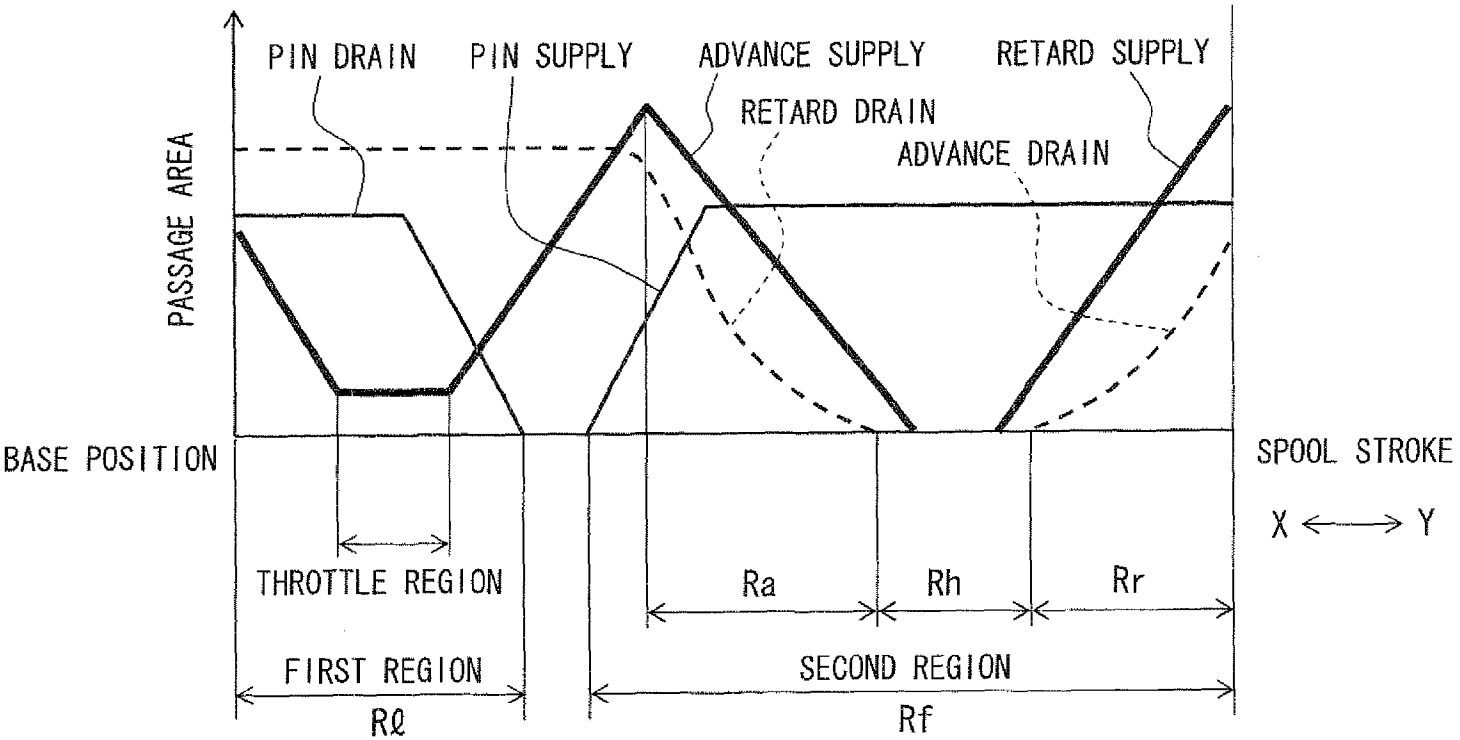
FIG. 14 is a graph showing a relationship between regions of a spool and a passage sectional area between ports in a control portion of a valve timing control apparatus according to a third embodiment.

The third embodiment as a modification of the second embodiment will be described with reference to FIGS. 14 to 19. As shown in FIG. 14, a valve timing control apparatus 1B of the third embodiment is different from the valve timing control apparatus of the first and second embodiments in a control to throttle the advance supply flow and not to throttle the retard drain flow in the throttle region of the lock region (first region) RI. In the present third embodiment, a control described with reference to FIG. 5 is performed in the regions other than the throttle region of FIG. 14. The valve timing control apparatus 1B of the third embodiment performs the flow control in the throttle region in this manner. Therefore, a spool 70A and a sleeve portion 66A in a control valve 60A of the third embodiment have different structures from the corresponding components of the first and second embodiments.

The phase lock portion 30A of the third embodiment has a similar structure to that of the second embodiment.

(Control Portion)

As follows, difference of the control valve 60A controlled by the control portion 40A from that of the first and second embodiments will be described. As shown in FIGS. 15 to 19, the spool 70A has multiple annular lands 701, 701A, 703 formed to be slidable relative to the inner circumferential periphery of the sleeve portion 66A. The lands 700, 701A, 703 are arranged in the axial direction and spaced by predetermined distances. The advance land 700 is most spaced from the stationary portion 62. The advance land 700 is supported by the sleeve portion 66A. The advance land 700 is located in at least one of a space between the advance port 661 and the discharge opening 666 and a space between the advance port 661 and the main supply port 664 according to the movable position of the spool 70. The retard land 701A is located on the side of the stationary portion 62 from the advance land 700. The retard land 701A is also supported by the sleeve portion 66. The retard land 701A is located in at least in one of a space between the retard port 662 and the main supply port 664 and a space between the retard port 662 and the lock port 663 according to the movable position of the spool 70. The retard land 701A has a structure formed by extending the retard land 701 to the first lock land 702 in the first embodiment such that the retard land 701 is integrated with the first lock land 702.

The lock land 703 is located on the side of the stationary portion 62 from the retard land 701A. The lock land 703 is supported by the sleeve portion 66A. The lock land 703 is movable between the sub-supply port 665 and the lock port 663 according to the movable position of the spool 70A. The second lock land 703 is supported by the sleeve portion 66A. The second lock land 703 is located between the sub-supply port 665 and the stationary portion 62 irrespective of the movable position of the spool 70A.

The communication passage 704 is formed in the spool 70A. The communication passage 704 further has the second drain port 704*b* located in the retard land 701A. The second drain port 704*b* opens in the outer periphery of the spool 70A. The communication passage 704 is communicable with one of the retard port 662 and the lock port 663 through the second drain port 704*b* according to the movable position of the spool 70A. The second drain port 704*b* functions as an exhaust retard drain port to discharge a working fluid from the retard chambers 26, 27, 28 to the exhaust passage 53 according to the movable position of the spool 70A. The second drain port 704*b* further functions as an exhaust pin drain port to discharge a working fluid from the lock chamber 31 to the passage 53 through the lock passage 200 and the lock port 663. An annular first throttle portion 710 is provided between the advance land 700 and the retard land 701A. The first throttle portion 710 is projected in the radial direction from the outer periphery of the spool 70A. The first throttle portion 710 forms a throttle passage with a corresponding inner circumferential periphery of the sleeve portion 66A. The first throttle portion 710 has a function to control a flow of a circulating working fluid by applying a flow resistance when the working fluid circulates through the throttle passage in the axial direction of the spool 70A. The first throttle portion 710 functions as an advance supply throttle portion configured to control a flow of a working fluid circulating from the main supply port 664 to the advance port 661 and control a flow of a working fluid supplied to the advance chambers 22, 23, 24 according to the movable position of the spool 70A.

The control valve 60A of the present third embodiment does not include the second throttle portion 711 of the control valve 60 described in the first embodiment. In the present structure, the control valve 60A does not include the second throttle portion 711. Thereby, in the throttle region of the lock region (first region) RI shown in FIG. 14, the control valve 60A maintains the retard drain flow at a substantially constant quantity, without throttling the retard drain flow.

The first throttle portion 710 forms the throttle passage. The first sleeve side projection 669 is provided to a portion of the sleeve portion 66 opposed to the first throttle portion 710 in the radial direction. In the present embodiment, the control valve 60A does not include the second throttle portion 711 described in the first embodiment. Correspondingly, the control valve 60A does not include the second sleeve side projection 670 of the control valve 60 described in the first embodiment.

Figure 16:
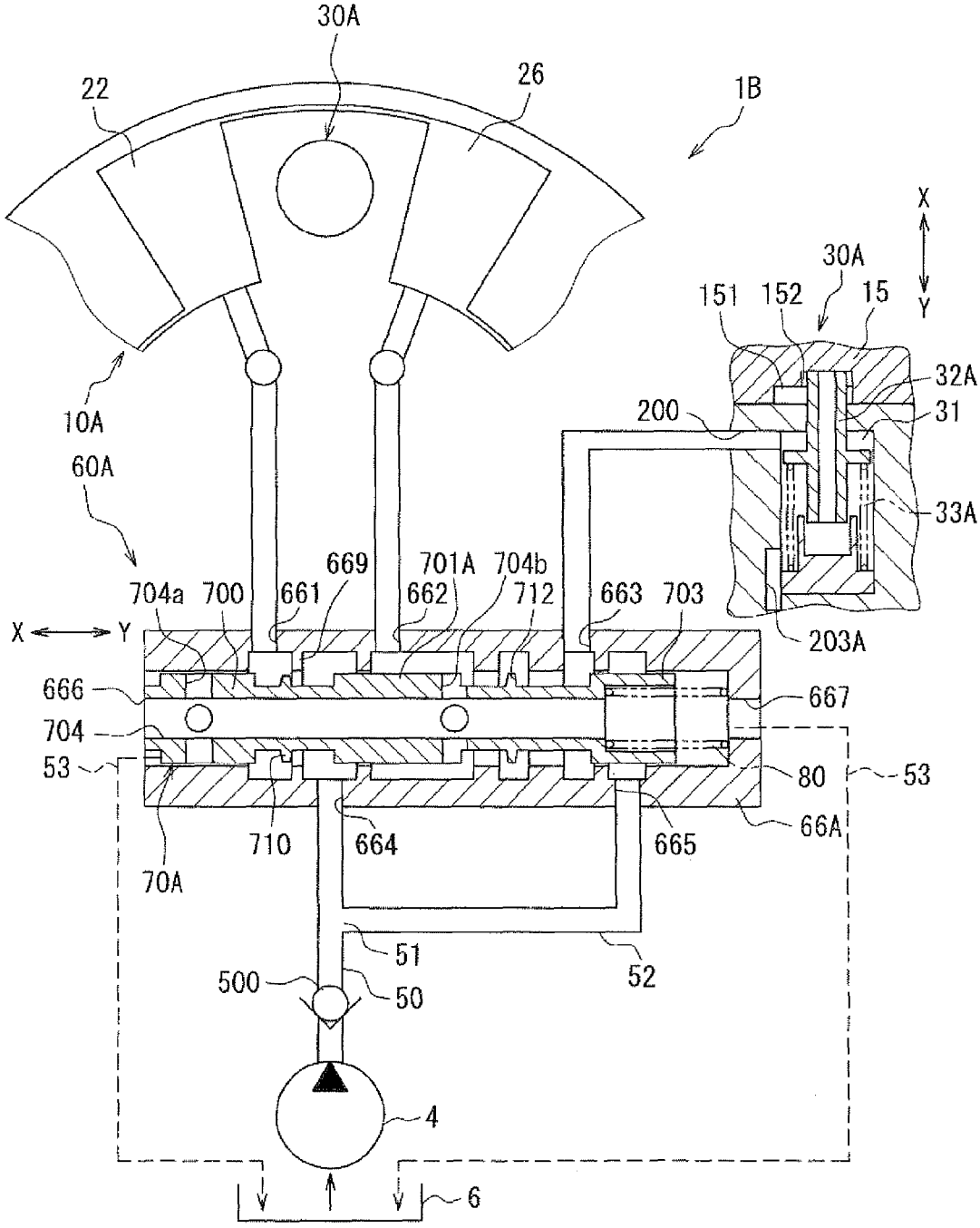
FIG. 16 is an enlarged sectional view showing the main component in an operational state different from that of FIG. 15.
Figure 17:
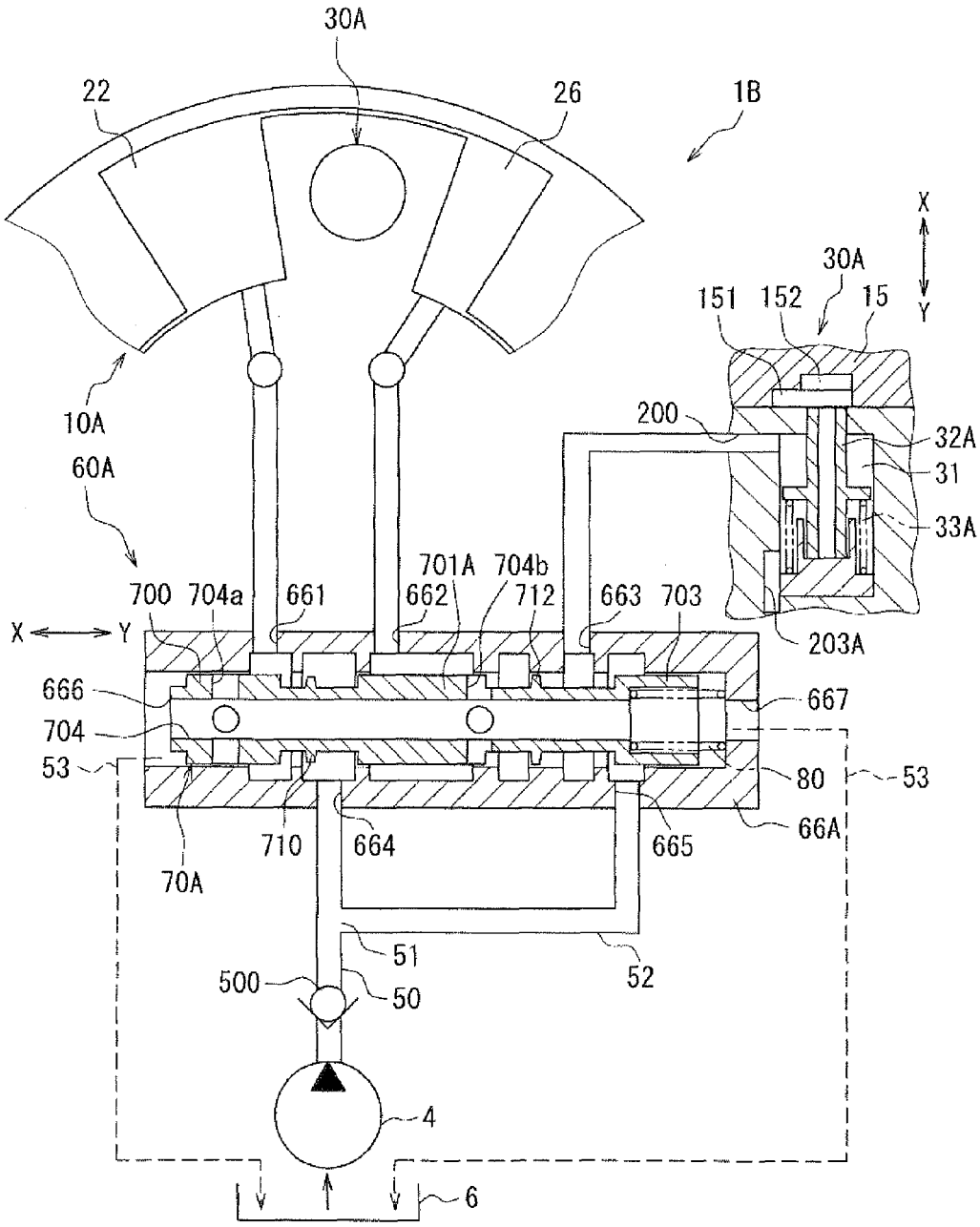
FIG. 17 is an enlarged sectional view showing the main component in an operational state different from those in FIGS. 15, 16.
Figure 18:
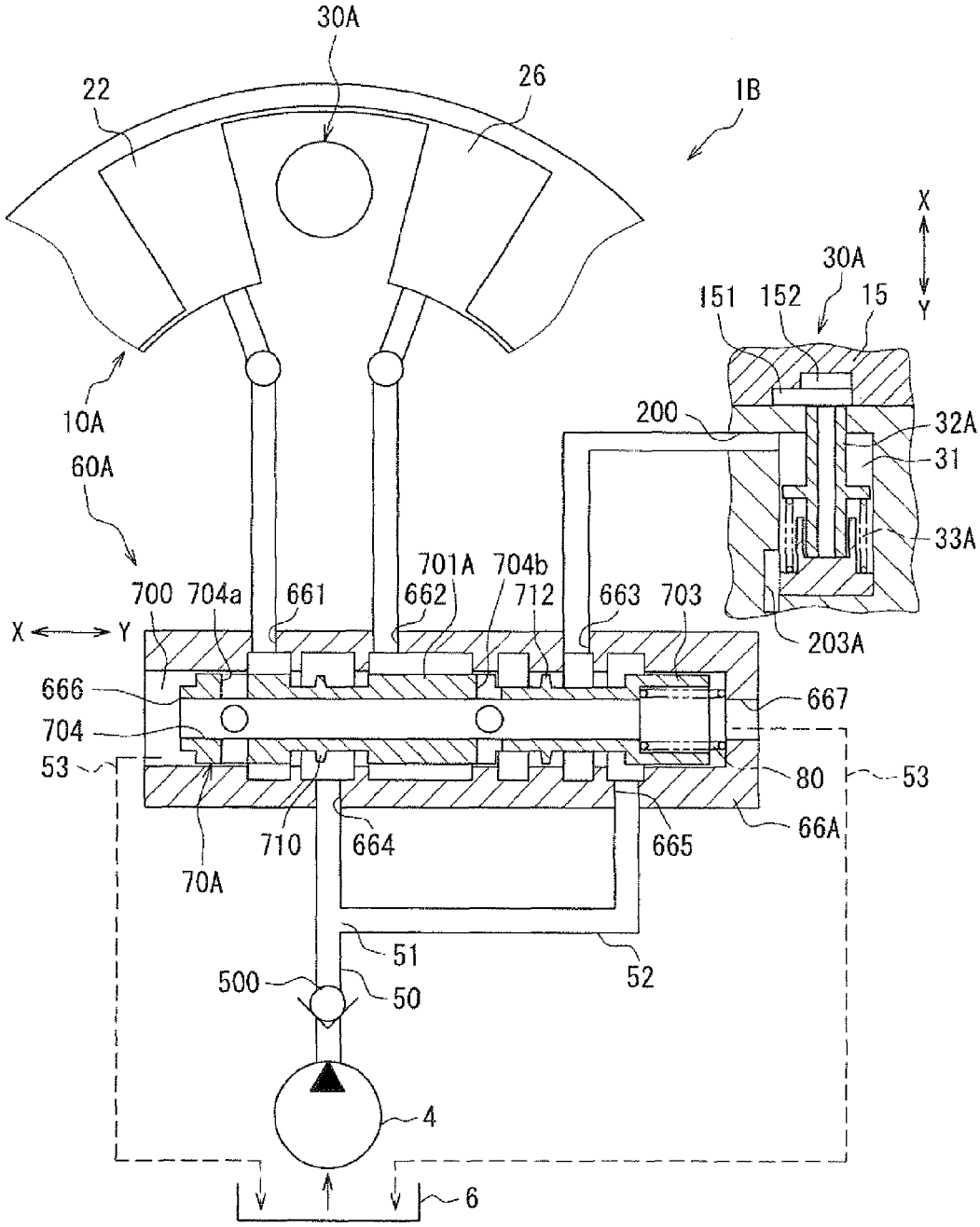
FIG. 18 is an enlarged sectional view showing the main component in an operational state different from those in FIGS. 15 to 17.
Figure 19:
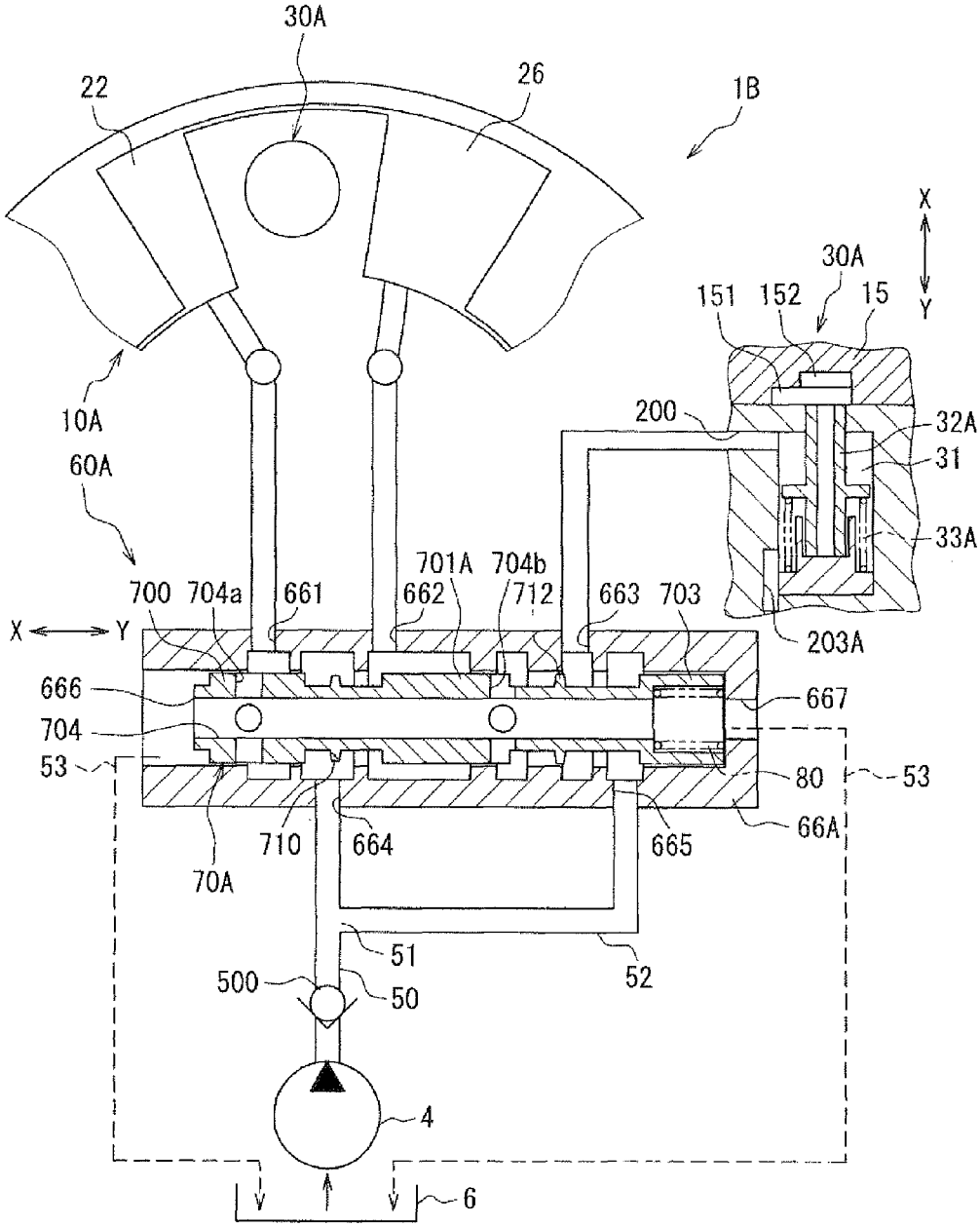
FIG. 19 is an enlarged sectional view showing the main component in an operational state different from those in FIGS. 15 to 18.

An annular pin drain open-close portion 712 is provided between the second lock land 703 and the retard land 701A. The pin drain open-close portion 712 is projected in the radial direction from the outermost periphery of the spool 70A. The pin drain open-close portion 712 is provided in the spool 70A and located in a prescribed position relative to the inner periphery of the sleeve portion 66. According to the movable portion of the spool 70A, the pin drain open-close portion 712 is positioned in a sliding region, in which the pin drain open-close portion 712 slides relative to the inner periphery of the sleeve portion 66A, or positioned in a passage formation region, in which the pin drain open-close portion 712 forms a passage with the inner periphery of the sleeve portion 66A. As shown in FIGS. 17 to 19, the pin drain open-close portion 712 blocks the lock port 663 from the second drain port 704*b* when being in the sliding region. Alternatively, as in FIGS. 15, 16, the pin drain open-close portion 712 permits communication between the lock port 663 and the second drain port 704*b* when being in the passage formation region.

In the present structure, as shown in FIG. 14, a first region RI (lock region RI) is a stroke range including a spool base position and a throttle region. The spool base position is an end of a movable range of the spool 70 in the first direction X. In the throttle region, an advance supply flow is throttled. The advance supply flow is a flow of a working fluid supplied to the advance chambers 22, 23, 24.

Figure 15:
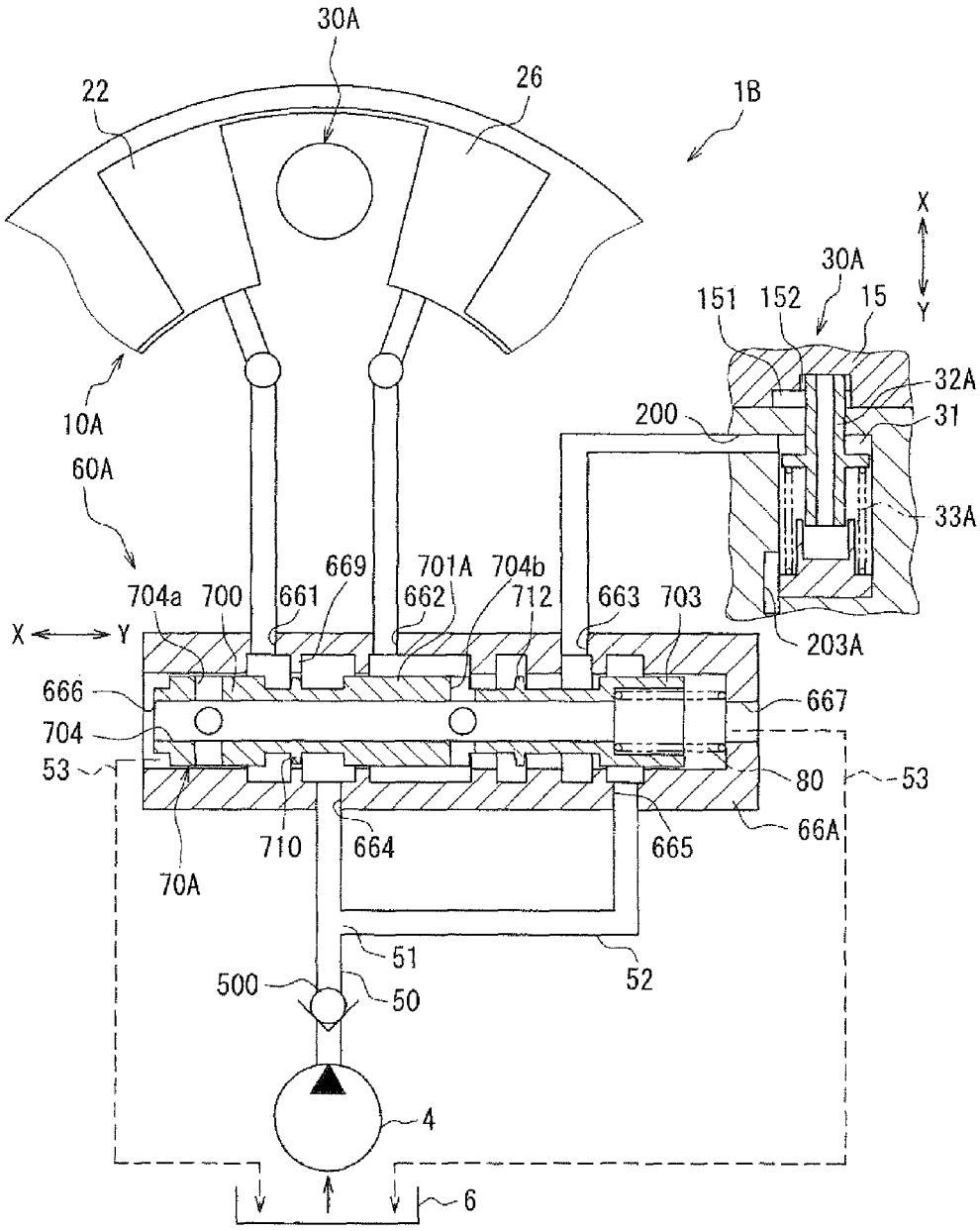
FIG. 15 is an enlarged view showing a main component of the control portion shown in FIG. 14.

The first regulating member 32A of the phase lock portion 30A is fitted to the locking recess portion 152 in the lock region RI, thereby the rotation phase of the vane rotor 14 relative to the housing 11 is maintained. As shown in FIGS. 15 and 16, the spool 70A is in the lock region RI to communicate the advance port 661 with the main supply port 664 across the advance land 700 and the retard land 701A. The spool 70A in the lock region RI blocks the sub-supply port 665 from other ports.

Further, as shown in FIG. 15, when the spool 70A is in the throttle region, a passage area, which is a dominant factor of a circulation flow of a working fluid between the ports 661, 664, is controlled to be smaller than the passage area of the corresponding passage when the spool 70A is in the spool base position as shown in FIG. 16. That is, the opening area of the throttle passage defined by the first throttle portion 710 in FIG. 15 when the spool 70A is in the throttle region is controlled to be smaller than the opening area of the throttle passage defined by the first throttle portion 710 in FIG. 16 when the spool 70A is in the spool base position. Therefore, the advance supply flow in the throttle region is smaller than the advance supply flow in the spool base position to enable a phase advance at a slow rotation speed. Thus, the phase change can be gradually performed.

As the spool position of the spool 70 moves in the second direction Y from the spool base position to the throttle region in the first region RI, the distance between the first throttle portion 710 and the inner circumferential periphery of the first sleeve side projection 669 of the sleeve portion 66A becomes small. Therefore, the passage area between the ports decreases, and the advance supply flow also decreases.

Furthermore, the pin drain open-close portion 712 maintains the passage area between the lock port 663 and the second drain port 704*b* when the spool 70A moves from the spool base position to the throttle region in the first region RI. Therefore, a pin drain flow is substantially constant. Further, when the spool 70A moves in the second direction Y from an intermediate point in the throttle region to the end of the first region RI, the pin drain open-close portion 712 moves to block the passage. Therefore, the passage area between the ports is continually reduced, and the pin drain flow is also continually decreased. Finally, the pin drain open-close portion 712 blocks the passage when being in the end in the second direction Y, and the pin drain flow becomes zero.

As the spool position of the spool 70 moves in the second direction Y from the end of the throttle region in the second direction Y toward the second region Rf, the distance between the first throttle portion 710 and the inner circumferential periphery of the first sleeve side projection 669 of the sleeve portion 66A becomes large. Therefore, the passage area between the ports increases, and the advance supply flow also increases. In the first region RI, the passage area between the retard port 662 and the second drain port 704*b* does not greatly change. Therefore, the retard drain flow is substantially constant.

As shown in FIG. 14, the second region Rf, which is shifted from the lock region RI in the second direction Y, includes the advance region Ra, the holding region Rh, and the retard region Rr. As shown in FIGS. 17 to 19, in the phase lock portion 30A, the first regulating member 32A in the second region Rf moves away from the locking recess portion 152 and the first regulating recess portion 151. Thereby, the lock of the rotation phase of the vane rotor 14 relative to the housing 11 is released. In addition, the control valve 60 performs the position control of the spool 70 to set the rotation phase to the advance region Ra, the holding region Rh, or the retard region Rr. In the advance region Ra, the rotation phase changes to the advance side. In the holding region Rh, the rotation phase is maintained. In the retard region Rr, the rotation phase changes to the retard side.

As shown in FIG. 17, similarly to the lock region RI, the spool 70A moves to the advance region Ra to communicate the advance port 661 with the main supply port 664 across the advance land 700 and the retard land 701A. As shown in FIG. 17, a passage area, which is defined by the first throttle portion 710 and a dominant factor of a circulation flow of a working fluid between the ports 661, 664, is controlled to be larger than the passage area of the corresponding passage when the spool 70A is in the lock region RI as shown in FIG. 15. Accordingly, as shown in FIG. 14, the advance supply flow in the advance region Ra is greater than the advance supply flow in the throttle region.

As shown in FIG. 17, when the spool 70A is in the advance region Ra, in the area between the retard land 701A and the second lock land 703, the retard port 662 communicates with the communication passage 704 through the second drain port 704*b*, and the retard port 662 communicates with the discharge opening 666, 667 through the passage 704. The spool 70A in the advance region Ra communicates the lock port 663 with the sub-supply port 665 in the area between the retard land 701A and the second lock land 703. In addition, the spool 70 blocks the lock port 663 from the second drain port 704*b* by the pin drain open-close portion 712, which is slidable on the inner periphery of the sleeve portion 66A. Therefore, the lock port 663 is enabled to communicate with the main supply port 664 through the sub-supply passage 52, which communicates with the port 665.

In the advance region Ra, as the spool position moves in the second direction Y, the distance between the advance land 700 and the inner periphery of the first sleeve side projection 669 of the sleeve portion 66A become small. Therefore, the passage area between the ports decreases, and the advance supply flow decreases. In addition, the distance between the retard land 701A and the inner circumferential periphery of the sleeve portion 66A also becomes small, and the passage area between the ports decreases. Thus, the retard drain flow decreases. Further, in the second region Rf, as the spool position moves in the second direction Y, the passage area between the ports increases by movement of the second lock land 703 to an intermediate position of the advance region Ra. Subsequently, the passage area between the ports becomes substantially constant to the end of the second region Rf in the second direction Y. Therefore, the pin supply flow, which is a flow of a working fluid supplied to the lock chamber 31, becomes constant after the increase.

As shown in FIG. 14, the spool 70A moves to the holding region Rh, which is shifted from the advance region Ra in the second direction Y. In the present condition, as shown in FIG. 18, the spool 70A blocks the advance port 661 from other ports. The spool 70A in the holding region Rh blocks the retard port 662 from other ports.

Further, as shown in FIG. 19, when the spool 70A moves to the retard region Rr, the advance port 661 communicates with the exhaust passage 53 through the first drain port 704*a* on the opposite side of the retard land 701A through the advance land 700. When the spool 70A is in the retard region Rr, the retard port 662 is communicated with the main supply port 664 in the area between the advance land 700 and the retard land 701A. Similarly to the case of the advance region Ra, the spool 70A in the retard region Rr communicates the lock port 663 with the sub-supply port 665 in the area between the retard land 701A and the second lock land 703. In addition, the spool 70A blocks the lock port 663 from the second drain port 704*b* by the pin drain open-close portion 712, which is slidable on the inner periphery of the sleeve portion 66A. Therefore, the lock port 663 is enabled to communicate with the main supply port 664 through the sub-supply passage 52, which communicates with the port 665.

(Operation of Device)

Subsequently, a difference of an operation of the valve timing control apparatus 16 from that of the first embodiment will be described.

(I-1) Lock Operation, Throttle Region Operation (First Region RI)

When an internal combustion engine is in a starting operation or an idling operation, or when an internal combustion engine is stopped, pressure of a working fluid is low. In such a condition, the control circuit 92 energizes the driving source 90 to control the control valve 60 thereby to move the spool 70A to the lock region RI (first region RI). In the present condition, when the operation state is changed from a normal operation state, where lock of the first regulating member 32A of the phase lock portion 30A is released, to a lock state, the control circuit 92 drives the through spool 70A via the driving shaft 91 to once change the rotation phase from the lock phase to the retard side. The control circuit 92 further provides an instruction corresponding to the throttle region (FIG. 15) in the first region RI.

Consequently, the advance port 661, which communicates with each of the advance chambers 22, 23, 24 through the passages 41, 42, 43, 44, and the main supply port 664, which communicates with the pump 4, are communicated with each other. Thus, a working fluid is supplied from the pump 4 to each of the advance chambers 22, 23, 24. In addition, the retard port 662, which communicates with each of the retard chambers 26, 27, 28 through the passages 45, 46, 47, 48, and the discharge openings 666, 667, which communicate with the exhaust passage 53, are communicated with each other through the communication passage 704. Thus, a working fluid is discharged from each of the retard chambers 26, 27, 28. The advance supply flow in the throttle region is controlled to be significantly smaller than that in other regions of the first region RI other than the throttle region. In the present condition, the rotation speed of the vane rotor 14 toward the advance side accompanied with the flow controlled to be small is significantly gradual and slow, compared with the rotation speed in other regions of the first region RI other than the throttle region.

Further, the lock port 663, which communicates with the lock chamber 31 through the lock passage 200, is further communicated with the discharge openings 666, 667 through the communication passage 704. Thus, a working fluid is discharged from the lock chamber 31. The vane 141 gradually advances in the order shown by FIGS. 13A, 13B, 13C according to the slow rotation of the vane rotor 14. In addition, the first regulating member 32A moves in the thrust direction X accompanied with the outflow of a working fluid from the lock chamber 31. In the gradual advance movement of the valve timing control apparatus 1 caused by the control valve 60A, when the first regulating member 32A is in the rotation phase corresponding to the locking recess portion 152, the first regulating member 32A is fitted into the locking recess portion 152 by being applied with resilience of the first resilient member 33. Thus, the rotation phase lock is completed.

In this manner, the first regulating member 32A of the phase lock portion 30A locks the rotation phase correspondingly to the position of the spool 70 in the throttle region in the first region RI. Further, the valve timing control apparatus 1B is supplied with a throttled flow. Thereby, the advance operation can be performed with a slow rotation speed. Thus, the rotation phase can be steadily locked.

Further, the resilience of the coil spring 100 is effective between the most retard phase and the lock phase. In addition, the coil spring 100 applies a larger torque than an average torque of the camshaft 2 to the vane rotor 14. Therefore, the vane rotor 14 can be advanced by the coil spring 100 to the lock phase. When the first regulating member 32A is advanced to a rotation phase corresponding to the locking recess portion 152, the first regulating member 32A is fitted into the locking recess portion 152 by being applied with the resilience of the first resilient member 33A. Thus, the rotation phase lock is completed.

(I-2) Starting of Internal Combustion Engine (First Region RI)

Before starting of the internal combustion engine, a working fluid has not been supplied yet. In such a condition, air is contained in a main body of the valve timing control apparatus 1B, a supply passage of the pump 4 as a supply source, and the like. When the internal combustion engine is being started, as shown in FIGS. 14, 16, the spool 70A of the control valve 60A is in the spool base position. In the present condition, the advance port 661 is communicated with the main supply port 664, and a working fluid is supplied from the pump 4 into each of the advance chambers 22, 23, 24. Further, in the phase lock portion 30A, the first regulating member 32A locks the rotation phase by being applied with resilience of the first resilient member 33A in a condition where the first regulating member 32A discharges a working fluid from the lock chamber 31 by being applied with resilience of the first resilient member 33A.

(II) Advance Operation (Advance Region Ra)

For example, an internal combustion engine requires a relatively large engine torque when being operated in a low or middle speed and applied with a high load. In such a condition, the control circuit 92 energizes the driving source 90 to perform a driving power control of the control valve 60A. Thereby, the control circuit 92 controls the spool 70A to move to the advance region Ra shown in FIG. 17.

Consequently, accompanied with the lock operation (I-1), the advance port 661 is communicated with the main supply port 664, and a working fluid is supplied from the pump 4 into each of the advance chambers 22, 23, 24. In addition, the retard port 662 is communicated with the second drain port 704*b*, and a working fluid is discharged from each of the retard chambers 26, 27, 28 to the exhaust passage 53. Further, the lock port 663, which is communicated with the lock chamber 31 through the lock passage 200, and the sub-supply port 665, which is communicated with the pump 4 through the sub-supply passage 52, are communicated with other. Thus, a working fluid is supplied into the lock chamber 31. Accompanied with supply of a working fluid into the lock chamber 31, the first regulating member 32A is moved in the retract direction Y against resiliency of the first resilient member 33A. Thus, the first regulating member 32A is retracted from the locking recess portion 152 and the first regulating recess portion 151, and the lock is released.

As described above, when the spool 70A is in the advance region Ra, a working fluid is supplied into each of the advance chambers 22, 23, 24 and discharged from each of the retard chambers 26, 27, 28 in the state where the lock of the first regulating member 32A is released by supplying a working fluid into the lock chamber 31. For example, the spool 70A is moved to a marginal position of the advance region Ra on the side of the lock region RI in FIG. 14. Thereby, a circulation flow of a working fluid becomes the maximum between the ports 661, 664 through the maximum passage area in the advance region Ra. Therefore, the valve timing can be quickly advanced.

(III) Holding Operation (Holding Region Rh)

For example, an internal combustion engine is in a normal operation when an acceleration pedal of the vehicle is maintained in a constant position. In such a condition, the control circuit 92 energizes the driving source 90 to perform a driving power control of the control valve 60. Thereby, the control circuit 92 controls the spool 70A to move to the holding region Rh shown in FIG. 18.

Consequently, the advance port 661, which is communicated with each of the advance chambers 22, 23, 24 through the passages 41, 42, 43, 44, is blocked from the others ports. Therefore, supply of a working fluid into each of the advance chambers 22, 23, 24 is stopped, and a working fluid is accumulated in each of the advance chambers 22, 23, 24. In addition, the retard port 662, which is communicated with each of the retard chambers 26, 27, 28 through the passages 45, 46, 47, 48, is blocked from the others ports. Therefore, supply of a working fluid into each of the retard chambers 26, 27, 28 is stopped, and a working fluid is accumulated in each of the retard chambers 26, 27, 28. Furthermore, accompanied with the advance operation (II), the lock port 663, the main supply port 664, and the sub-supply port 665 are communicated with each other. Thus, a working fluid is supplied into the lock chamber 31.

As described above, when the spool 70A is in the holding region Rh, a working fluid is supplied into each of the advance chambers 22, 23, 24 and each of the retard chambers 26, 27, 28 in the state where the lock of the first regulating member 32A is released by supplying a working fluid into the lock chamber 31, similarly to the advance operation (II). In this manner, the valve timing can be maintained.

(IV) Retard Angle Operation (Retard Region RI)

For example, an internal combustion engine requires a relatively small engine torque when being applied with a low load. In such a condition, the control circuit 92 energizes the driving source 90 to perform a driving power control of the control valve 60A. Thereby, the control circuit 92 controls the spool 70A to move to the retard region Rr shown in FIG. 19.

Consequently, the advance port 661, which communicates with each of the advance chambers 22, 23, 24 through the passages 41, 42, 43, 44, and the discharge openings 666, which communicates with the exhaust passage 53, are communicated with each other through the first drain port 704*a* and the communication passage 704. Thus, a working fluid is discharged from each of the advance chambers 22, 23, 24. In addition, the retard port 662, which communicates with each of the retard chambers 26, 27, 28 through the passages 45, 46, 47, 48, and the main supply port 664, which communicates with the pump 4, are communicated with each other through the passages 45, 46, 47, 48. Thus, a working fluid is supplied from the pump 4 into each of the retard chambers 26, 27, 28. Furthermore, accompanied with the advance angle operation (II), the lock port 663 and the sub-supply port 665 are communicated with each other. Thus, a working fluid is supplied into the lock chamber 31.

As described above, when the spool 70A is in the retard region Rr, a working fluid is supplied into the lock chamber 31 to release the lock of the first main regulating member 32 similarly to the advance angle operation (II) and the holding operation (III). Thus, a working fluid is supplied into each of the retard chambers 26, 27, 28, and a working fluid is discharged from each of the advance chambers 22, 23, 24, in the state where the lock of the first main regulating member 32 is released similarly to the advance angle operation (II) and the holding operation (III). For example, the spool 70A is moved to a marginal position of the retard region Rr, which is a movable end in the second direction Y in FIG. 14. Thereby, a circulation flow of a working fluid becomes the maximum between the ports 662, 664 through the maximum passage area in the retard region Rr. Therefore, the valve timing can be quickly retarded.

Other Embodiment

As described above, the present invention is not limited to the above embodiments, and is capable of being applied to various embodiments as long as being undeviating from the gist thereof.

For example, the retard chambers 26, 27, 28 may be communicated with the branch passages 42, 43, 44, and the advance chambers 22, 23, 24 may be communicated with the branch passages 46, 47, 48. Thereby, the port 661 communicated with the retard chambers 26, 27, 28 through the passages 41, 42, 43, 44 may be communicated with the main supply port 664 in the regions RI and Ra. The control valve 60 may be accommodated in the vane rotor 14. Alternatively, the control valve 60 may be accommodated in the camshaft 2. Alternatively, the control valve 60 may be provided in a working fluid path, which extends from the pump 4 to the actuator portion 10 through the camshaft 2. In this case, the control valve 60 may be provided on the upstream side of the camshaft 2.

In the first embodiment, the pin for regulating the rotation phase from changing to the retard side in the second regulation structure 110 may be a single pin configured of a single element. In the first embodiment, the second components of the regulation device may be omitted from the valve timing control apparatus.

In the above embodiments, the above-described structure is applied to the valve timing control apparatus for an intake valve. Alternatively, the above-described structure may be applied to an apparatus for controlling a valve timing of an exhaust valve (valve train). Alternatively, the above-described structure may be applied to an apparatus for controlling a valve timing of each of an intake valve and an exhaust valve.

The valve timing control apparatus according to the second embodiment or the third embodiment may be provided with the sub-check valve 520 in the sub-supply passage 52. When the valve timing control apparatus according to the second embodiment or the third embodiment is provided with the sub-check valve 520, the same operation effect as that of the first embodiment can be obtained, and the lock released state of the first regulating member 32A can be maintained with the backflow restriction function. Therefore, the valve timing can be quickly controlled in the second region Rf.

Summarizing the above embodiments, a valve timing control apparatus for controlling a valve timing of a valve opened and closed by a camshaft according to a torque transmitted from a crankshaft in an internal combustion engine by utilizing a hydraulic fluid supplied from a supply source accompanied with a driving operation of an internal combustion engine, the valve timing control apparatus including:

a housing interlocked with the crankshaft and rotatable with the crankshaft, the housing having a recess dented from an inner surface;

a vane rotor interlocked with the camshaft and rotatable with the camshaft, the vane rotor having a vane partitioning an interior of the housing into an advance chamber and a retard chamber in a rotative direction, the vane rotor configured to change a rotation phase relative to the housing to an advance side or a retard side when a hydraulic fluid is supplied into the advance chamber or the retard chamber;

a lock unit having a lock chamber, the lock unit configured to lock the vane rotor relative to the housing when a hydraulic fluid is discharged from the lock chamber, the lock unit configured to release the lock when a hydraulic fluid is supplied into the lock chamber;

a valve body having an operation port communicable with each of the advance chamber and the retard chamber, a lock port communicable with the lock chamber, a supply port configured to be supplied with a hydraulic fluid from the supply source, and an exhaust port configured to discharge a hydraulic fluid;

a valve element linearly movable in a first direction and a second direction opposite from each other, the valve element configured to respectively communicate the operation port and the lock port with the supply port and the exhaust port when moving to a first region, which is a stroke range including an end of a movable range of the valve element in the first direction, the valve element configured to communicate both the operation port and the lock port with the supply port when moving to a second region, which is a stroke range shifted from the first region in the second direction;

a bias unit configured to cause a biasing force to bias the valve element in the first direction when being elastically deformed; and a driving source configured to cause a driving force to move the valve element in the second direction.

The lock unit includes:

a regulating member accommodated in the vane rotor and movable back and forth, the regulating member configured to lock the rotation phase in a regulation phase between a maximum advanced phase and a maximum retard phase when moving in a thrust direction to thrust into the recess, the regulating member configured to release the lock of the rotation phase when moving in a retract direction to be retracted from the recess; and a resilient member configured to bias the regulating member in the thrust direction to thrust the regulating member into the recess when being in the regulation phase, the resilient member configured to bias the regulating member to be in contact with an inner surface of the housing when being in a rotation phase other than the regulation phase.

The first region is a lock region in which the rotation phase is locked to the regulation phase by the regulating member.

The first region includes a throttle region in which the operation port, which communicates with the advance chamber, is communicated with the supply port such that an advance supply flow supplied to the advance chamber is throttled to be less than a flow when the valve element is in the end of the movable range in the first direction.

In the present structure, when the valve element moves to the first region to respectively communicate the operation port and the lock port with the supply port and the exhaust port, a hydraulic fluid is supplied from the supply source to the advance chamber, and a hydraulic fluid is discharged from the lock chamber, thereby the lock is established. Alternatively, when the valve element moves to the second region to communicate both the operation port and the lock port with the supply port, a hydraulic fluid is supplied from the supply source to the lock chamber and the advance chamber or the retard chamber. Thus, the rotation phase can be changed in a condition where the lock is released. Further, the advance supply flow in the throttle region, which is included in the first region in which the rotation phase is locked to the regulation phase, is throttled to be smaller than the advance supply flow when the valve element is in the end of the movable range in the first direction in the first region. In the present structure, in the throttle region in which a quantity of a hydraulic fluid flowing into the advance chamber becomes small, the rotation speed of the vane rotor to the advance side becomes low according to the flow controlled to be small. Further, the lock port is communicated with the exhaust port to discharge a hydraulic fluid from the lock chamber simultaneously with the slow phase change of the vane rotor to the advance side. The outflow of a hydraulic fluid from the lock chamber causes the regulating member to thrust in the thrust direction to lock the rotation phase. In the present structure, the phase change of the vane rotor to the advance side is carried out at a slow speed. Therefore, the regulating member can be easily and steadily thrust into the recess of the housing. In the present structure of the valve timing control apparatus, in which the single control valve including the valve element and the valve body is driven, the rotation phase control of the vane rotor and the phase lock control using the regulating member can be performed. In addition, the phase locking performance in the regulation phase can be enhanced.

The regulating member may be a main regulating member.

The lock unit further includes:

a pressure-receiving portion accommodated in the vane rotor and movable back and forth in a direction same as the movable direction of the main regulating member, the pressure-receiving portion configured to be applied with a pressure in the retract direction from a hydraulic fluid supplied into the lock chamber;

a sub-regulating member having a fitted portion configured to be fitted to the main regulating member in the retract direction and configured to be spaced from the main regulating member in the thrust direction; and a sub-resilient member configured to bias the sub-regulating member in the thrust direction.

In the present structure, a hydraulic fluid is supplied from the supply source with an operation of the internal combustion engine, and the hydraulic fluid is supplied into the lock chamber. The internal combustion engine may cause a lock to stop before the main regulating member thrusts into the recess to regulate the rotation phase within the regulation phase between the maximum advanced phase and the maximum retarded phase. In such a condition, pressure of a hydraulic fluid fed into the lock chamber decreases. Consequently, the sub-regulating member located in the pressure-receiving portion is applied with pressure in the retract direction from a hydraulic fluid in the lock chamber. Thus, the sub-regulating member moves in the thrust direction by being biased from the sub-resilient member. In the present condition, the main regulating member, to which the sub-regulating member is fitted via the fitted portion in the retract direction, is biased from the main resilient member to move with the sub-regulating member. Therefore, the main regulating member makes contact with the inner surface of the housing in a rotation phase other than the regulation phase in particular. Thus, the main regulating member makes contact with the inner surface of the housing to be immovable relative to the housing. Even after such a condition, the sub-regulating member biased from the sub-resilient member moves to extrude remaining hydraulic fluid in the lock chamber via the pressure-receiving portion. Simultaneously, the sub-regulating member is movable in the thrust direction relative to the main regulating member to be spaced from the fitted portion. In this manner, in a clanking operation when the internal combustion engine is started, the rotation phase is changed to the regulation phase by applying the fluctuating torque caused by the clanking operation to thrust the main regulating member into the locking recess portion. Thus, the fitted portion of the main regulating member can be moved in the thrust direction at a high speed, irrespective of a remaining hydraulic fluid in the lock chamber. Therefore, the rotation phase can be further steadily locked by movement of the main regulating member in the thrust direction. Therefore, the phase lock performance can be further enhanced.

The sub-regulating member is fitted to an outer periphery of the main regulating member. The vane rotor has a supporting portion configured to support the outer periphery of the main regulating member. The lock chamber is formed in the vane rotor and defined by the pressure-receiving portion of the sub-regulating member opposed to the supporting portion.

In the present structure, the outer periphery of the main regulating member, which is configured to be fitted with the sub-regulating member, is supported by the supporting portion of the vane rotor. In addition, the lock chamber is defined by the pressure-receiving portion of the sub-regulating member opposed to the supporting portion. Thereby, pressure of the hydraulic fluid supplied into the lock chamber is hard to be applied to the main regulating member. Therefore, a hydraulic fluid remaining in the lock chamber may not disturb the movement of the main regulating member in the thrust direction. Therefore, a performance of the rotation phase lock can be secured by the structure of the lock unit.

The vane rotor has an advance communication passage, which communicates with the advance chamber, and a retard communication passage, which communicates with the retard chamber. The sub-regulating member is configured to communicate the advance communication passage with the retard communication passage when moving in the thrust direction beyond a blockade position, in which the sub-regulating member blocks the advance communication passage from the retard communication passage.

In the present structure, the sub-regulating member moves beyond the blockade position by being applied with a resiliency of the sub-resilient member in a direction to discharge a hydraulic fluid thereby to permit the main regulating member to lock the resilience phase. In addition, the sub-regulating member moves to communicate the advance communication passage with the retard communication passage. Therefore, the advance chamber is also communicated with the retard chamber. When the internal combustion engine is started, the valve element is located in the end of the movable range in the first direction and located in the first region. In the present condition, the operation port, which is communicated with the advance chamber, is communicated with the supply port. Therefore, a hydraulic fluid fed from the supply source is supplied into the advance chamber. When the internal combustion engine is started, a hydraulic fluid is supplied from the supply source. Thereby, a hydraulic fluid flows through the advance chamber, the advance communication passage, the retard communication passage, the retard chamber, and the operation port communicated with the retard chamber, and the exhaust port in this order. Thus, a hydraulic fluid discharged from the exhaust port is supplied to the advance chamber by the supply source. In this manner, a hydraulic fluid supplied from the supply source quickly circulates through the circulation path. Therefore, air contained in the circulation path is replaced with a hydraulic fluid, and the replaced air is discharged. Therefore, when the internal combustion engine is started, a hydraulic fluid quickly spreads in the valve timing control apparatus. Thereby, a waiting time to starting the valve timing control apparatus can be shortened, and the phase control required for an operation of the internal combustion engine can be quickly performed.

The housing has an air hole opened to an atmosphere. The air hole is communicated between the advance communication passage and the retard communication passage when the sub-regulating member moves in the thrust direction beyond the blockade position.

In the present structure, when the internal combustion engine stops before the rotation phase is locked by the main regulating member moved in the thrust direction, the sub-resilient member moves in the thrust direction beyond the blockade position to communicate the air hole with the communication passages. Under such a communication state, even when a hydraulic fluid remains in one of the advance chamber and the retard chamber in a clanking operation when the internal combustion engine is started, a hydraulic fluid remaining in the one chamber can be moved to the other chamber through the advance communication passage and the retard communication passage, which are communicated with both the advance chamber and the retard chamber. In addition, in the starting operation, even when the viscosity of a hydraulic fluid is high and such a hydraulic fluid is hard to be moved due to, for example, deterioration, coldness, and/or the like, air can be supplied into the advance chamber and the retard chamber through the air hole. Therefore, when the rotation phase is changed to the regulation phase and when the main regulating member is thrust into the locking recess portion, the following conditions can be restrained: decrease in a speed of a rotation phase change due to a hydraulic fluid remaining in the advance chamber or the retard chamber; and decrease in a speed of a rotation phase change due to negative pressure caused in the advance chamber or the retard chamber due to increase in a volume caused by a fluctuating torque under a clanking operation. Therefore, a starting performance of the valve timing control apparatus can be enhanced so as to quickly change the rotation phase required for thrusting the main regulating member into the locking recess portion.

An opening area of the air hole is larger than a passage sectional area of the advance communication passage and the retard communication passage. In this case, in a communication path formed by the sub-regulating member moved in the thrust direction to communicate the air hole with the advance communication passage and the retard communication passage, a flow resistance of air becomes smaller than a flow resistance of a hydraulic fluid. Therefore, in a clanking operation when the internal combustion engine is started under a state in which the air hole is communicated with the advance communication passage and the retard communication passage, a hydraulic fluid is restricted from leaking from the advance chamber and the retard chamber, which are respectively in communication with the advance communication passage and the retard communication passage. Thus, air can be easily supplied into the advance chamber and the retard chamber. Therefore, when the rotation phase is changed to the regulation phase and when the main regulating member is thrust into the locking recess portion, the speed change of the rotation phase is enhanced, and a starting performance of the valve timing control apparatus can be enhanced.

The vane rotor has an advance communication passage, which communicates with the advance chamber, and a retard communication passage, which communicates with the retard chamber. The regulating member is configured to communicate the advance communication passage with the retard communication passage when moving in the thrust direction beyond a blockade position, in which the regulating member blocks the advance communication passage from the retard communication passage.

In the present structure, the regulating member moves beyond the blockade position by being applied with a resiliency of the resilient member in a direction to discharge a hydraulic fluid thereby to permit the regulating member to lock the resilience phase. In addition, the regulating member moves to communicate the advance communication passage with the retard communication passage. Therefore, the advance chamber is also communicated with the retard chamber. When the internal combustion engine is started, the valve element is located in the end of the movable range in the first direction and located in the first region. In the present condition, the operation port, which is communicated with the advance chamber, is communicated with the supply port. Therefore, a hydraulic fluid fed from the supply source is supplied into the advance chamber. When the internal combustion engine is started, a hydraulic fluid is supplied from the supply source. Thereby, a hydraulic fluid flows through the advance chamber, the advance communication passage, the retard communication passage, the retard chamber, and the operation port communicated with the retard chamber, and the exhaust port in this order. Thus, a hydraulic fluid discharged from the exhaust port is supplied to the advance chamber by the supply source. In this manner, a hydraulic fluid supplied from the supply source quickly circulates through the circulation path. Therefore, air contained in the circulation path is replaced with a hydraulic fluid, and the replaced air is discharged. Therefore, when the internal combustion engine is started, a hydraulic fluid quickly spreads in the valve timing control apparatus. Thereby, a waiting time to starting the valve timing control apparatus can be shortened, and the phase control required for an operation of the internal combustion engine can be quickly performed.

The valve timing control apparatus further includes an assisting spring to apply a biasing force larger than an average value of a fluctuating torque, which is transmitted from the camshaft and eccentrically applied toward the retard side on average, the assisting spring biasing the vane rotor toward the advance side against the fluctuating torque. The biasing force of the assisting spring disappears on the advance side relative to the regulation phase.

In the present structure, when being on the retard side relative to the regulation phase, the assisting spring enables to change the rotation phase to the regulation phase by applying the biasing force of the assisting spring when the internal combustion engine stops. Contrary, when being on the advance side relative to the regulation phase, the rotation phase can be changed to the regulation phase when the internal combustion engine stops by utilizing a fluctuating torque eccentrically acting toward the retard side on average. In the present structure, the internal combustion engine can be steadily started by controlling the rotation phase from both sides in the engine start operation. Thus, a phase locking performance in the regulation phase can be enhanced.

Further, in the throttle region, the operation port, which is communicated with the retard chamber, is communicated with the exhaust port. Thereby, a retard drain flow discharged from the retard chamber is throttled to be smaller than a flow when the valve element is in the end of the movable range in the first direction.

In the present structure, both an advance supply flow and a retard drain flow are throttled in the throttle region in the first region. The rotation phase may be locked in a condition where the cam torque fluctuation is large. In such a condition, even when a hydraulic fluid is discharged from the retard chamber and air flows into the retard chamber due to fluctuation of the vane rotor, change in the rotation phase can be restricted by throttling both the advance supply flow and the retard drain flow in the throttle region in a condition where the lock is released in the subsequent condition.

The valve element is linearly movable inside the valve body. The valve element has an annular first throttle portion projected in a radial direction from an outer periphery of the valve element. An advance supply passage is formed between the first throttle portion and the valve body to communicate the operation port, which is communicated with the advance chamber, with the supply port. A cross-sectional area of the advance supply passage when the valve element is in the throttle region is controlled to be smaller compared with a cross-sectional area of the advance supply passage when the valve element is in the end of the movable range in the first direction.

In the present structure, the throttle region included in the first region is formed by providing the annular first throttle portion to be projected in the radial direction from the outer periphery of the valve element. In the present structure, it suffices to form the valve element to have the cross-sectional area of the advance supply passage formed between the first throttle portion and the valve body such that an advance supply flow is obtained as a desired throttle flow. Therefore, the valve timing control apparatus having the throttle region can be manufactured with a high productivity.

The valve element has an annular second throttle portion projected in a radial direction from an outer periphery of the valve element. A retard drain passage is formed between the second throttle portion and the valve body to communicate the operation port, which is communicated with the retard chamber, with the exhaust port. A cross-sectional area of the retard drain passage when the valve element is in the throttle region is controlled to be smaller compared with a cross-sectional area of the retard drain passage when the valve element is in the end of the movable range in the first direction.

In the present structure, the throttle region included in the first region is formed by providing the annular second throttle portion to be projected in the radial direction from the outer periphery of the valve element. In the present structure, it suffices to form the valve element to have the cross-sectional area of the retard drain passage formed between the second throttle portion and the valve body such that a retard drain flow is obtained as a desired throttle flow. Therefore, the valve timing control apparatus having the throttle region can be manufactured with a high productivity. In addition, when a communication passage is provided to communicate the advance chamber with the retard chamber, the retard drain flow is throttled in the throttle region in addition to the advance supply flow. Therefore, the slow phase change of the vane rotor toward the advance side can be further promoted.

The valve element 70 has multiple annular lands 700 to 703 slidable relative to an inner periphery of a sleeve portion 66 of the valve body 61. Each of the first throttle portion 710 and the second throttle portion 711 has a diameter smaller than a diameter of the multiple annular lands 700 to 703.

The above processings such as calculations and determinations are not limited being executed and performed by the control portion 40, 40A. The control unit may have various structures including the control portion 40, 40A shown as an example.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A valve timing control apparatus for controlling a valve timing of a valve configured to be opened and closed by a camshaft in accordance with a torque transmitted from a crankshaft of an internal combustion engine, the valve timing control apparatus configured to control the valve timing by utilizing a hydraulic fluid supplied from a supply source with a driving operation of the internal combustion engine, the valve timing control apparatus comprising:

a housing rotatable with the crankshaft, the housing having a recess dented from an inner surface of the housing;

a vane rotor rotatable with the camshaft, the vane rotor having a vane partitioning an interior of the housing into an advance chamber and a retard chamber in a rotative direction, the vane rotor configured to change a rotation phase relative to the housing to an advance side or a retard side correspondingly when a hydraulic fluid is supplied into the advance chamber or the retard chamber;

a lock unit having a lock chamber, the lock unit configured to lock the vane rotor relative to the housing when a hydraulic fluid is discharged from the lock chamber, the lock unit configured to release the lock when a hydraulic fluid is supplied into the lock chamber;

a valve body having an operation port, which is communicable with the advance chamber and the retard chamber, a lock port, which is communicable with the lock chamber, a supply port, which is configured to be supplied with a hydraulic fluid from the supply source, and an exhaust port configured to discharge a hydraulic fluid;

a valve element linearly movable in opposite directions including a first direction and a second direction, the valve element configured to communicate the operation port and the lock port respectively with the supply port and the exhaust port when moving in a first region, which is a stroke range including an end of a movable range of the valve element in the first direction, the valve element configured to communicate both the operation port and the lock port with the supply port when moving in a second region, which is a stroke range shifted from the first region in the second direction;

a bias unit configured to cause a biasing force to bias the valve element in the first direction when being elastically deformed; and a driving source configured to cause a driving force to move the valve element in the second direction, wherein the lock unit includes:

a regulating member accommodated in the vane rotor and movable back and forth, the regulating member configured to lock the rotation phase in a regulation phase between a maximum advanced phase and a maximum retard phase when moving in a thrust direction to thrust into the recess, the regulating member configured to release the lock of the rotation phase when moving in a retract direction to be retracted from the recess; and a resilient member configured to bias the regulating member in the thrust direction to thrust the regulating member into the recess when being in the regulation phase, the resilient member configured to bias the regulating member to be in contact with an inner surface of the housing when being in a rotation phase other than the regulation phase, the first region is a lock region in which the regulating member locks the rotation phase in the regulation phase, and the first region includes a throttle region in which the operation port, which is communicated with the advance chamber, is further communicated with the supply port such that an advance supply flow supplied to the advance chamber is throttled to be less than an advance supply flow when the valve element is in the end of the movable range in the first direction.

2. The valve timing control apparatus according to claim 1, wherein the regulating member is a main regulating member, the lock unit further includes:

a sub-regulating member having a pressure-receiving portion accommodated in the vane rotor and movable back and forth in a direction same as a movable direction of the main regulating member, the pressure-receiving portion configured to be applied with a pressure in the retract direction from a hydraulic fluid supplied into the lock chamber, the sub-regulating member further having a fitted portion configured to be fitted to the main regulating member when moving in the retract direction and configured to be spaced from the main regulating member when moving in the thrust direction; and a sub-resilient member configured to bias the sub-regulating member in the thrust direction.

3. The valve timing control apparatus according to claim 2, wherein the sub-regulating member is fitted to an outer periphery of the main regulating member, the vane rotor has a supporting portion configured to support the outer periphery of the main regulating member, and the lock chamber is formed in the vane rotor and defined by the pressure-receiving portion of the sub-regulating member, the pressure-receiving portion being opposed to the supporting portion.

4. The valve timing control apparatus according to claim 2, wherein the vane rotor has an advance communication passage, which communicates with the advance chamber, and a retard communication passage, which communicates with the retard chamber, and the sub-regulating member is configured to communicate the advance communication passage with the retard communication passage when moving in the thrust direction beyond a blockade position, in which the sub-regulating member blocks the advance communication passage from the retard communication passage.

5. The valve timing control apparatus according to claim 4, wherein the housing has an air hole opened to an atmosphere, and the air hole is communicated with a space between the advance communication passage and the retard communication passage when the sub-regulating member moves in the thrust direction beyond the blockade position.

6. The valve timing control apparatus according to claim 5, wherein an opening area of the air hole is larger than a passage sectional area of the advance communication passage and the retard communication passage.

7. The valve timing control apparatus according to claim 1, wherein the vane rotor has an advance communication passage, which communicates with the advance chamber, and a retard communication passage, which communicates with the retard chamber, and the regulating member is configured to communicate the advance communication passage with the retard communication passage when moving in the thrust direction beyond a blockade position, in which the regulating member blocks the advance communication passage from the retard communication passage.

8. The valve timing control apparatus according to claim 1, further comprising:

an assisting spring configured to apply a biasing force for biasing the vane rotor toward the advance side against a fluctuating torque, which is transmitted from the camshaft and eccentrically applied toward the retard side on average, the biasing force being larger than an average value of the fluctuating torque, wherein the assisting spring is configured not to apply the biasing force to the advance side relative to the regulation phase.

9. The valve timing control apparatus according to claim 1, wherein the operation port, which is communicated with the retard chamber, is further communicated with the exhaust port when the valve element is in the throttle region, such that a retard drain flow discharged from the retard chamber when the valve element is in the throttle region is throttled to be smaller than a retard drain flow discharged from the retard chamber when the valve element is in the end of the movable range in the first direction.

10. The valve timing control apparatus according to claim 1, wherein the valve element is linearly movable inside the valve body, the valve element has an annular first throttle portion projected in a radial direction from an outer periphery of the valve element, the first throttle portion and the valve body form an advance supply passage therebetween to communicate the operation port, which is communicated with the advance chamber, with the supply port, and a cross-sectional area of the advance supply passage when the valve element is in the throttle region is controlled to be smaller than a cross-sectional area of the advance supply passage when the valve element is in the end of the movable range in the first direction.

11. The valve timing control apparatus according to claim 10, wherein the valve element further has an annular second throttle portion projected in the radial direction from the outer periphery of the valve element, the second throttle portion and the valve body form a retard drain passage therebetween to communicate the operation port, which is communicated with the retard chamber, with the exhaust port, and a cross-sectional area of the retard drain passage when the valve element is in the throttle region is controlled to be smaller than a cross-sectional area of the retard drain passage when the valve element is in the end of the movable range in the first direction.

12. The valve timing control apparatus according to claim 11, wherein the valve element has a plurality of annular lands slidable relative to an inner periphery of a sleeve portion of the valve body, and each of the first throttle portion and the second throttle portion has a diameter smaller than a diameter of the plurality of annular lands.

* * * * *